US007971747B2

(12) United States Patent
Blomdahl et al.

(10) Patent No.: US 7,971,747 B2
(45) Date of Patent: Jul. 5, 2011

(54) CLOSURE WITH UTENSIL

(75) Inventors: Corinne M. Blomdahl, Muskego, WI (US); Timothy M. Mazurkiewicz, Waukesha, WI (US); John M. Wisniewski, Wauwatosa, WI (US)

(73) Assignee: Seaquist Closures L.L.C., Mukwonago, WI (US)

( * ) Notice: Subject to any disclaimer, the term of this patent is extended or adjusted under 35 U.S.C. 154(b) by 402 days.

(21) Appl. No.: 12/229,686

(22) Filed: Aug. 26, 2008

(65) Prior Publication Data

US 2010/0051631 A1 Mar. 4, 2010

(51) Int. Cl.
*B65D 1/24* (2006.01)
*B65D 51/18* (2006.01)
*B65D 51/20* (2006.01)

(52) U.S. Cl. ..... 220/735; 220/212; 220/254.3; 220/255.1; 220/258.3; 220/521; 220/574.1

(58) Field of Classification Search ..... 220/212, 220/254.3, 254.5, 255.1, 258.1, 258.3, 375, 220/521, 574.1, 735
See application file for complete search history.

(56) References Cited

U.S. PATENT DOCUMENTS

| | | | | |
|---|---|---|---|---|
| 5,188,234 | A | 2/1993 | Fukuda et al. | |
| 5,946,807 | A | 9/1999 | Crane | |
| 6,371,324 | B1 | 4/2002 | Torniainen et al. | |
| 6,604,645 | B1 | 8/2003 | Vaupotic | |
| 6,604,646 | B2 | 8/2003 | Di Mario et al. | |
| 7,040,500 | B2 | 5/2006 | Kipperman et al. | |
| 7,562,786 | B2 * | 7/2009 | Morrison | 220/212 |
| 2002/0104852 | A1 | 8/2002 | Staniszewski et al. | |
| 2004/0232149 | A1 | 11/2004 | Chmela | |
| 2008/0156808 | A1 * | 7/2008 | Perry et al. | 220/560.03 |
| 2009/0184120 | A1 * | 7/2009 | Stevens | 220/212.5 |

FOREIGN PATENT DOCUMENTS

| | | |
|---|---|---|
| CH | 381606 | 10/1964 |
| FR | 2747107 | 10/1997 |
| WO | WO 93/17920 | 9/1993 |
| WO | WO 99/61337 | 12/1999 |

OTHER PUBLICATIONS

The "International Search Report and the Written Opinion of the International Searching Authority, or the Declaration" dated Sep. 22, 2009 for PCT/US2009/004451.

* cited by examiner

*Primary Examiner* — Anthony Stashick
*Assistant Examiner* — Madison L Wright
(74) *Attorney, Agent, or Firm* — Wood, Phillips, Katz, Clark & Mortimer

(57) ABSTRACT

A closure has a body and a lid is molded with the body. A utensil, such as a scoop or spear, is integrally formed with the closure body, and connected to the closure body via frangible connections. The lid includes a utensil-receiving structure for releasably holding the utensil, once it is initially broken away from the closure body, such that the utensil can be attached to the closure lid for storage.

19 Claims, 23 Drawing Sheets

FIG. 8
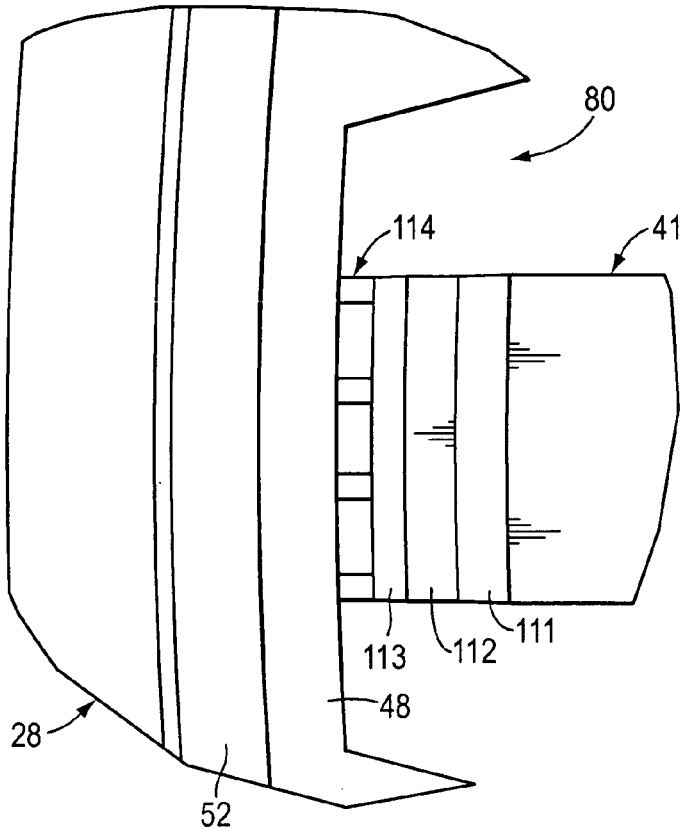
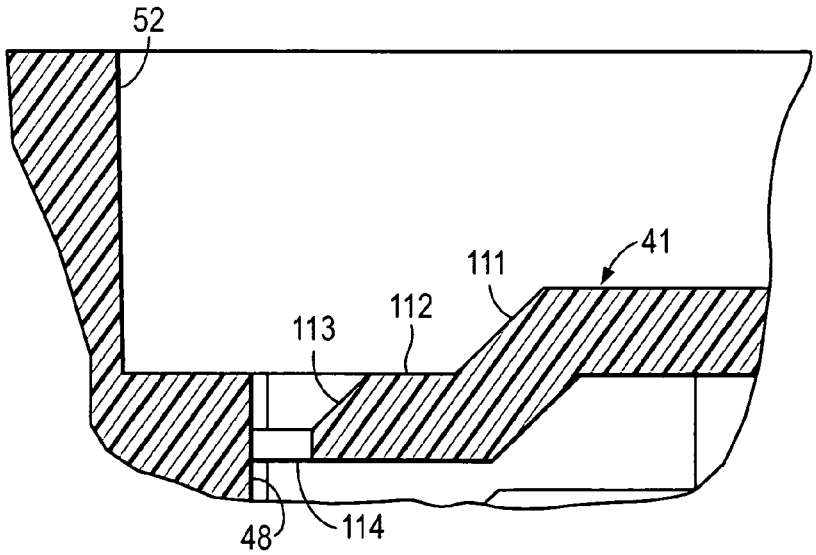
FIG. 9

FIG. 10
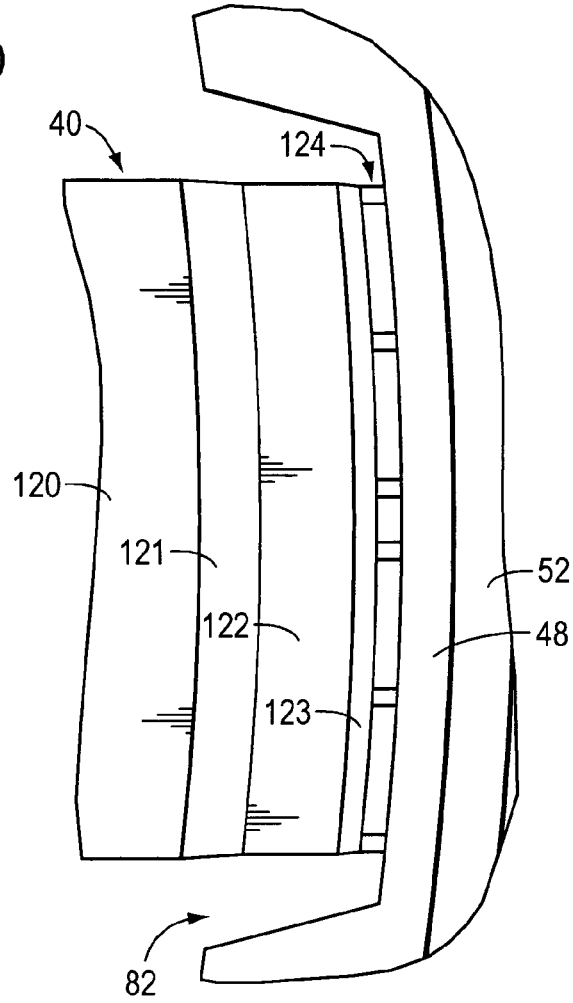
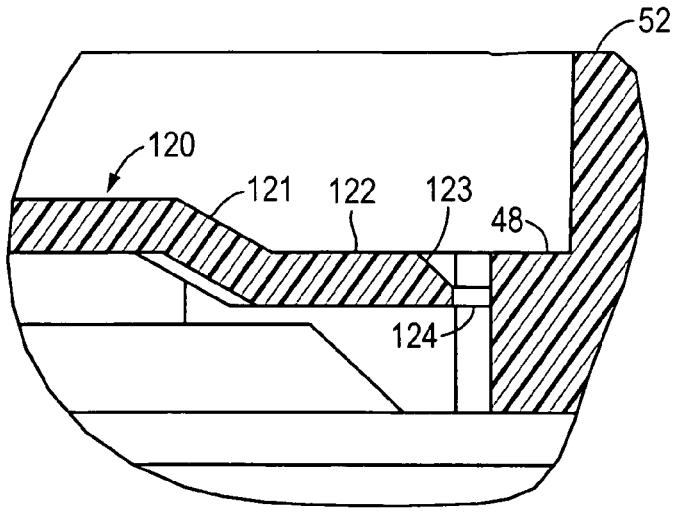
FIG. 11

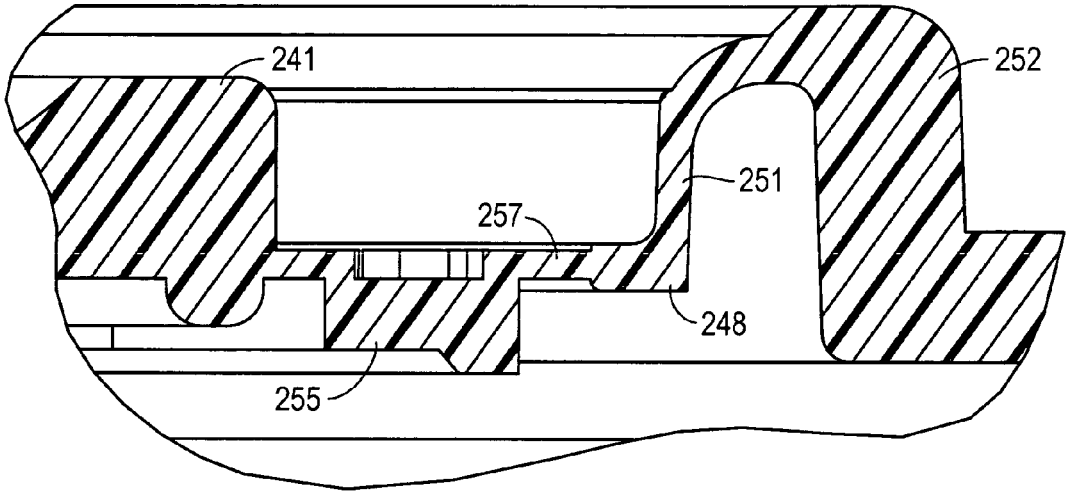
FIG. 28
FIG. 29
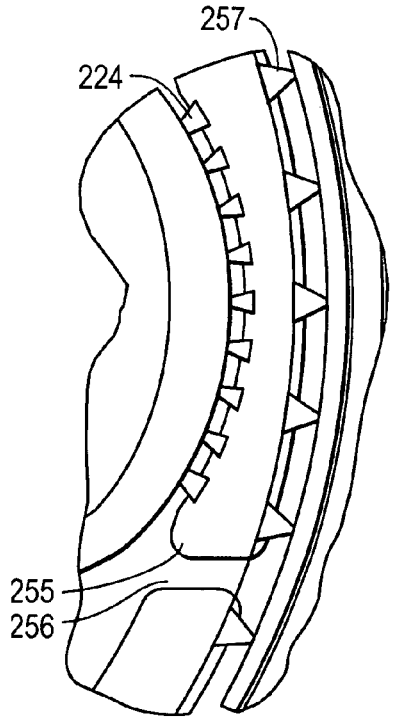

CLOSURE WITH UTENSIL

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a closure for a container.

BACKGROUND OF THE INVENTION AND TECHNICAL PROBLEMS POSED BY THE PRIOR ART

There are a variety of types of conventional closures. One type of prior art closure includes a body for being attached to the top of a container. The closure body, which may be alternatively described as the closure base or base portion, defines an opening which can communicate with the container interior. The closure further includes a lid which is hingedly mounted on the closure body and which can be lifted up to expose the opening to the container interior.

For some types of products, it is desirable to provide a closure that has a relatively large opening normally covered with a hinged lid that can provide access to the product (such as fluent products, as well as non-fluent products), and that, when opened, can accommodate the insertion of a utensil (e.g., scoop, spear, spoon, knife, ladle, etc.) through the open closure to permit the product to be stirred, speared and/or scooped out of the container with the utensil.

The inventors of the present invention have discovered how to provide a novel closure wherein the closure includes novel, advantageous features not heretofore taught or contemplated by the prior art.

BRIEF SUMMARY OF THE INVENTION

According to the present invention, an improved closure is provided for a container that has an opening to the container interior where a product may be stored. The closure can be initially molded as a separate unitary structure or as part of a container.

The closure includes a body for extending from the container and defining an opening for communicating with the container interior.

A utensil is initially molded with the body wherein (1) the utensil extends across at least part of the body opening, and (2) the utensil is frangibly connected with a frangible connection at least at a first location to the body.

The closure includes a lid and a hinge for connecting the lid with the body to accommodate movement of the lid between a closed position occluding the opening and an open position exposing the opening.

The lid includes a receiving structure adapted for holding the utensil in a releasable engagement after the frangible connection has been broken and the utensil has been moved into engagement with the receiving structure, whereby the utensil can be held in the lid when the lid is in the open position and when the lid is in the closed position.

The closure can be designed for easily accommodating molding of the closure. The closure can be provided with a design that accommodates efficient, high quality, large volume molding techniques with a reduced product reject rate.

The closure can be designed to accommodate its use with a variety of conventional or special containers having a variety of conventional or special container finishes, including conventional threaded or snap-fit attachment configurations.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 8 is a greatly enlarged, fragmentary, plan view of a portion of the structure enclosed within the circle designated FIG. 8 in FIG. 6;

FIG. 9 is a greatly enlarged, fragmentary, cross-sectional view of the portion of the structure enclosed in the circle designated FIG. 9 in FIG. 7;

FIG. 10 is a greatly enlarged, fragmentary, plan view of a portion of the structure enclosed in the circle designated FIG. 10 in FIG. 6;

FIG. 11 is a greatly enlarged, fragmentary, cross-sectional view of a portion of the structure enclosed in the circle designated FIG. 11 in FIG. 7;

FIG. 23 shows the as-molded, open condition of the closure wherein the closure lid is in the open condition to expose the inside of the closure lid and the inside of the closure body;

FIG. 28 is a greatly enlarged, fragmentary, cross-sectional view of a portion of the structure enclosed within the circle designated FIG. 28 in FIG. 25;

FIG. 29 is a greatly enlarged, fragmentary, plan view of a portion of the structure enclosed within the circle designated FIG. 29 in FIG. 24;

DESCRIPTION OF THE PREFERRED EMBODIMENTS

Figure 1:
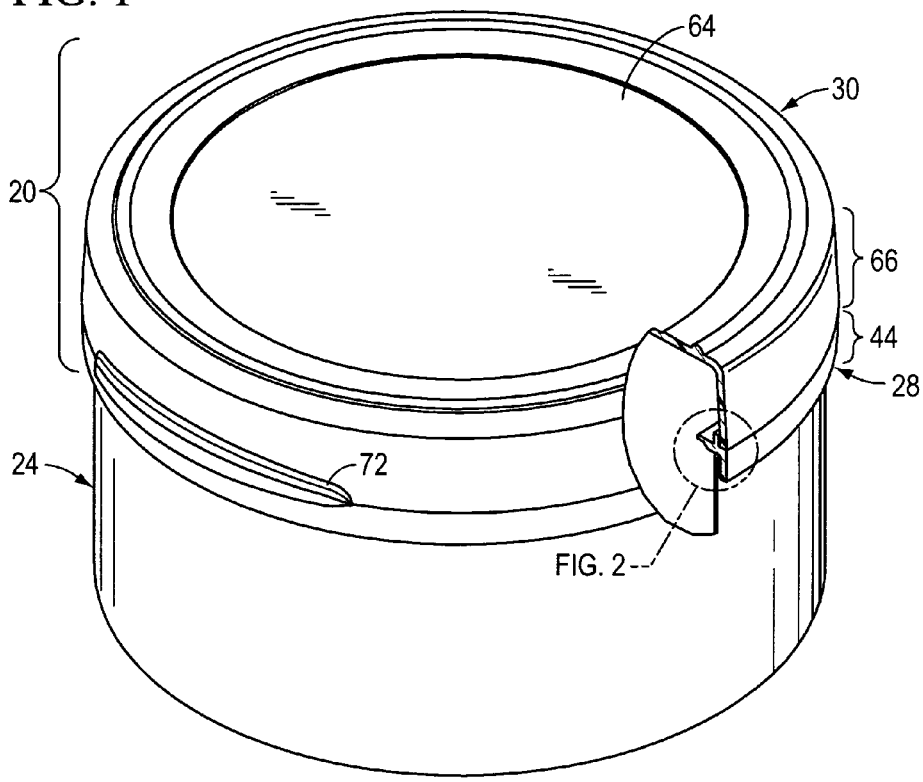
FIG. 1 is an isometric view of a first presently preferred embodiment of a closure of the present invention shown in a closed condition as initially manufactured and subsequently installed on a container in which a product is stored, and in FIG. 1 a portion of the structure is broken away to show a fragmentary cross sectional view.
Figure 3:
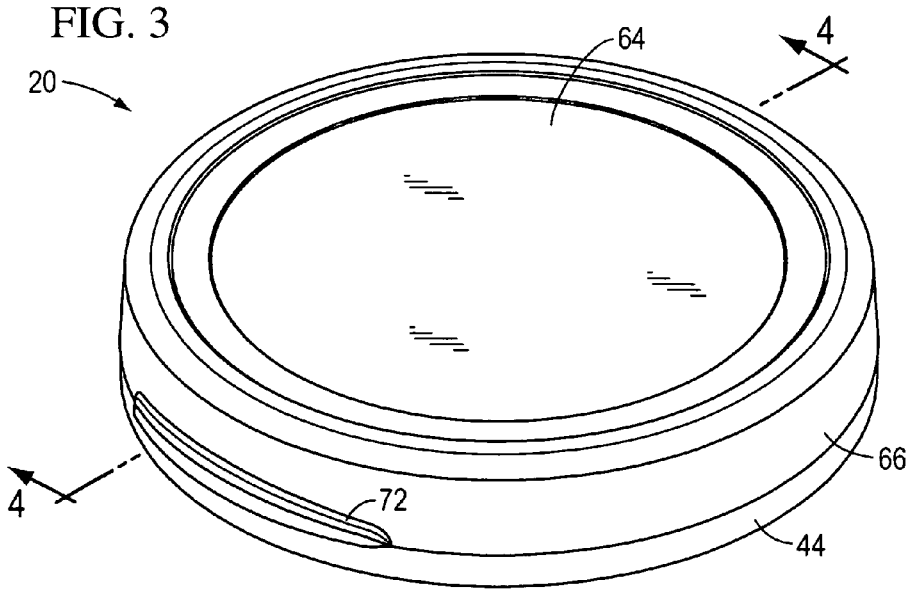
FIG. 3 is an isometric view of the closure in the closed condition prior to installation on the container shown in FIG. 1.

While this invention is susceptible of embodiment in many different forms, this specification and the accompanying drawings disclose only two specific forms as examples of the invention. The invention is not intended to be limited to the embodiments so described, however. The scope of the invention is pointed out in the appended claims.

For ease of description, the closure of this invention is described in a generally upright orientation that it could have at the upper end of a container when the container is stored upright on its bottom or base. It will be understood, however, that the closure of this invention may be manufactured, stored, transported, used, and sold in orientations other than those shown.

The closure of this invention is suitable for use with a variety of conventional or special containers having various designs, the details of which, although not illustrated or described, would be apparent to those having skill in the art and an understanding of such containers. With respect to the illustrated, preferred embodiments of the invention described herein, the container, per se, forms no part of, and therefore is not intended to limit, the broadest aspects of the present invention. It will also be understood by those of ordinary skill that novel and non-obvious inventive aspects can be embodied in the described exemplary closures alone.

One presently preferred embodiment of a closure of the present invention is illustrated in the Figures where it is designated generally therein by reference number 20. This embodiment of the closure 20 is initially provided as a separately manufactured article for mounting to the top of a container 24.

The container 24 typically has a mouth 26 (FIG. 2) which provides access to the container interior and product contained therein. The product may be, for example, mayonnaise, nuts, candies, jelly, margarine, paste, pickles, olives, etc., which can be removed from a container with a utensil, such as a scoop, spoon, ladle, knife, spear, etc. The product may also be a more highly fluent material that can be poured, as well as removed with a utensil, such as ground coffee, sugar, or other material, such as liquids, powders, slurries, etc. Such materials may be sold, for example, as a food product, a personal care product, an industrial or household product, or other substance (e.g., for internal or external use by humans or animals, or for use in activities involving medicine, manufacturing, commercial or household maintenance, construction, agriculture, etc.).

The particular illustrated container 24 does not have a reduced size upper end, such as a reduced size neck. However, if desired, the upper end of the container may have a neck or other suitable structure that defines the container mouth and that has a cross-sectional configuration with which the closure 20 is adapted to engage. Below the neck of such a container, the body of the container may have another cross-sectional configuration that differs from the cross-sectional configuration of the container mouth. On the other hand, as is the case with the illustrated container 24, the container may have a substantially uniform shape along its entire length or height without a neck portion of any significantly reduced size or significantly different cross-section.

The container 24 may or may not be a squeezable container having a flexible wall or walls which can be grasped by the user and compressed somewhat. However, the illustrated, preferred embodiment of the closure 20 is especially suitable for use with a container 24 having walls that are not necessarily intended to be squeezed by the user.

Figure 4:
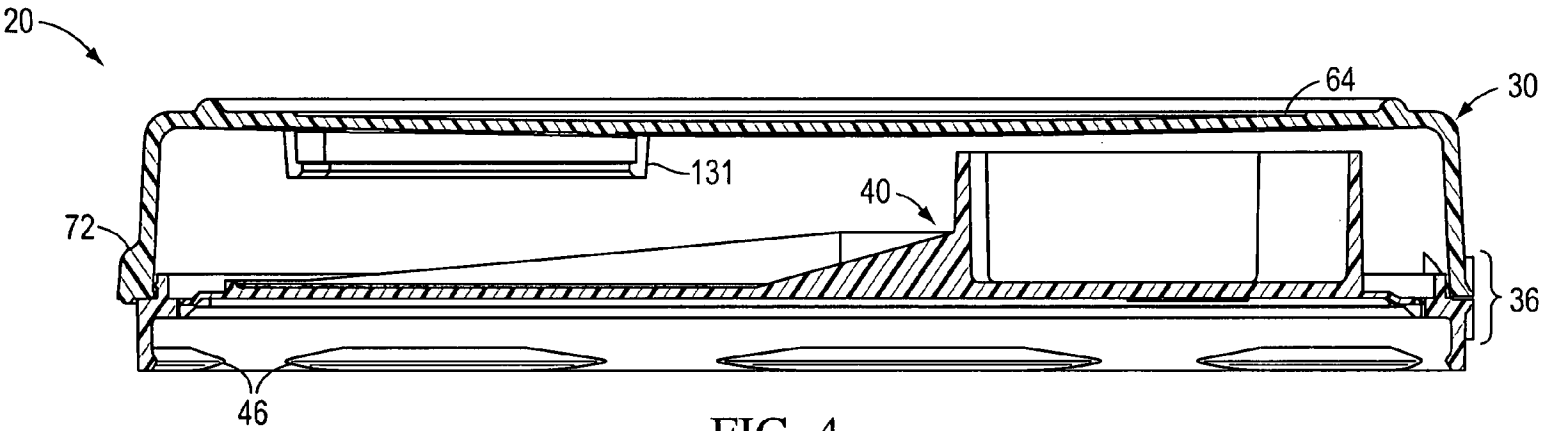
FIG. 4 is a cross-sectional view taken generally along the plane 4-4 in FIG. 3.

The preferred structure of the closure 20 comprises a body 28 (i.e., a peripheral wall or base) and a lid 30 (i.e., top or cover) joined to the body 28 by a hinge 36 (FIG. 4). In the preferred embodiment illustrated, the closure body 28, lid 30, and hinge 36 are molded together as a unitary structure from a suitable thermoplastic material such as polypropylene or the like. Other materials may be employed instead. The closure body 28 initially holds a utensil 40, such as, in the embodiment of FIGS. 1-22, a scoop, molded unitary with the closure body 28 in a manner that permits the utensil 40 to be subsequently detached from the body 28 by the user.

In the embodiment illustrated in FIGS. 1-22, the closure 20 is initially molded as a completely separate article that is subsequently attached to the container 24 after the container 24 has been initially filled with a product. The closure body 28 preferably has a depending skirt 44 with a conventional, segmented, internal bead 46 (FIG. 2) for snap-fit engagement with the bottom of a rim flange 47 on the upper end portion of the container 24 so as to secure the closure body 28 to the container 24. If desired, the bead 46 could be continuous instead of segmented.

The closure body 28 and container 24, if they have appropriately sized circular configurations, could also be releasably connected together with a screw thread system (not shown), a bead and groove system, or by other means. Alternatively, the closure body 28 may be permanently attached to the container 24 by means of induction bonding, ultrasonic bonding, gluing, or the like, depending upon the materials employed for the container 24 and closure body 28.

The closure body 28 may also include special or conventional seal features to provide an enhanced leak-tight seal between the closure body 28 and the container 24. The illustrated snap-fit closure body 28 does not employ such an enhanced seal feature.

Figure 2:
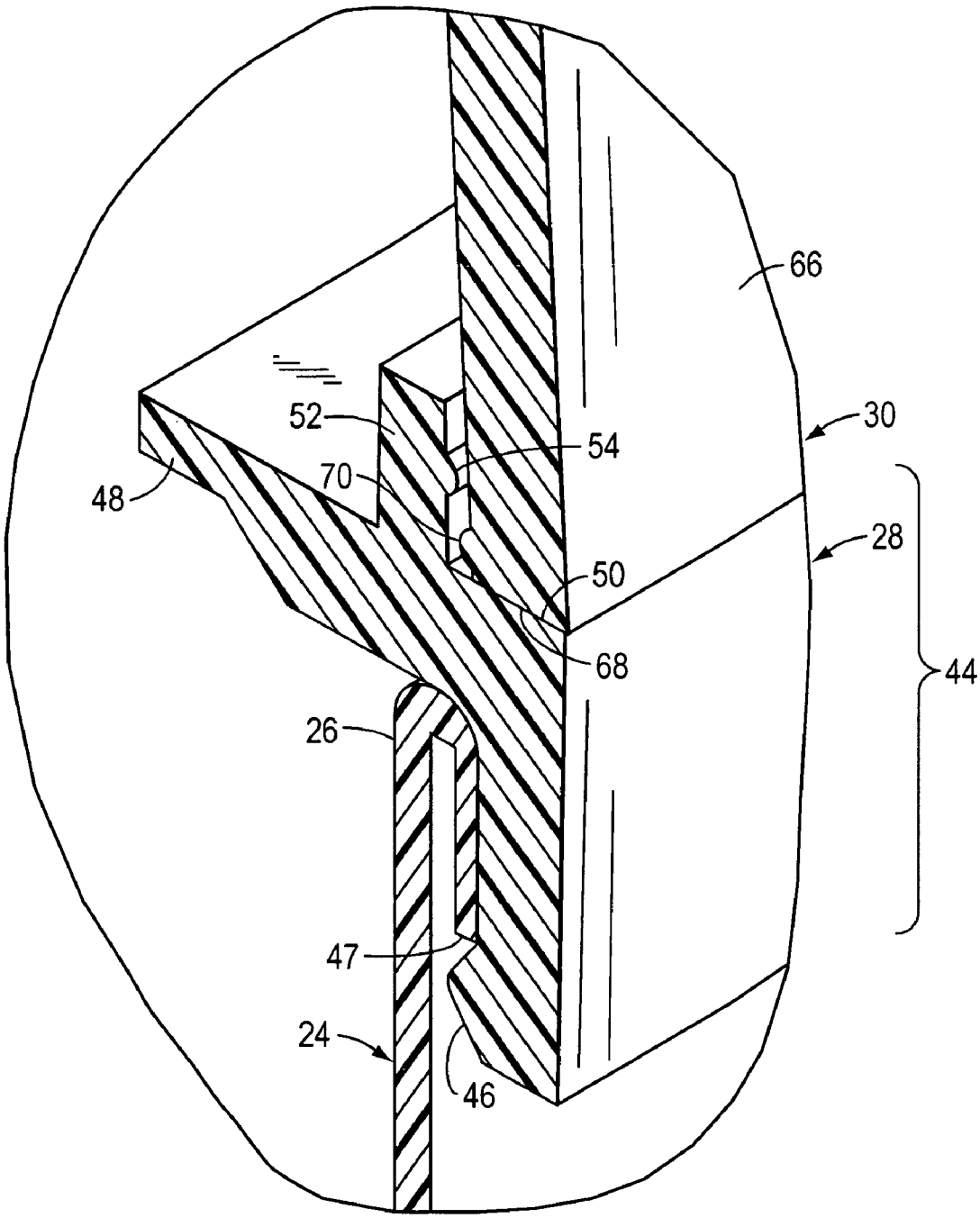
FIG. 2 is a greatly enlarged isometric view of the portion of the structure enclosed in the circle designated "FIG. 2" in FIG. 1.

With reference to FIG. 2, the closure body 28 has an inwardly extending flange or rim 48 near the top of the body 28. The body 28 has an exterior peripheral shoulder 50 at the upper portion of the skirt 44, and also has a generally annular neck or wall 52 projecting upwardly from the inner diameter of the shoulder 50. There is a very small, peripheral latch bead 54 which is located on the periphery of the wall 52 and which projects laterally outwardly from the wall 52 at an elevation above the shoulder 50. However, the latch bead 54 preferably does not extend all the way around the back of the closure body 28 in the region of the hinge 36.

The closure body 28 has an opening 60 (FIG. 5) defined by the rim 48. The opening 60 is adapted to be covered by the lid 30. The lid 30 includes a top deck or cover 64 substantially surrounded by a peripheral flange 66 (FIG. 5) having an end surface 68 for confronting, and abutting, the closure body shoulder 50 when the lid 30 is closed (FIG. 2). The bottom edge of the lid flange 66 includes an inwardly projecting latch bead 70 (FIGS. 2 and 5).

A finger tab or thumb tab 72 projects laterally outwardly at the front of the closure lid 30. When the lid 30 is closed on the body 28, the upwardly facing surface of the lid latch bead 70 is below, and is adapted to engage, the downwardly facing surface of the overlying closure body latch bead 54. The body wall 52 and/or the lid flange 66 are sufficiently flexible to accommodate temporary, elastic deformation as the beads 54 and 70 move past each other during the opening and closing actions. To open the lid 30, the user pushes with a thumb or finger upwardly on the bottom of the tab 72. Other conventional or special latch designs could be used instead.

The closure hinge 36 is molded unitary with the lid flange 66 and with the closure body 28 near the top of the body skirt 44 so as to accommodate movement of the lid 30 between the open position exposing the closure body opening 60, and the closed position occluding the closure body opening 60.

Figure 5:
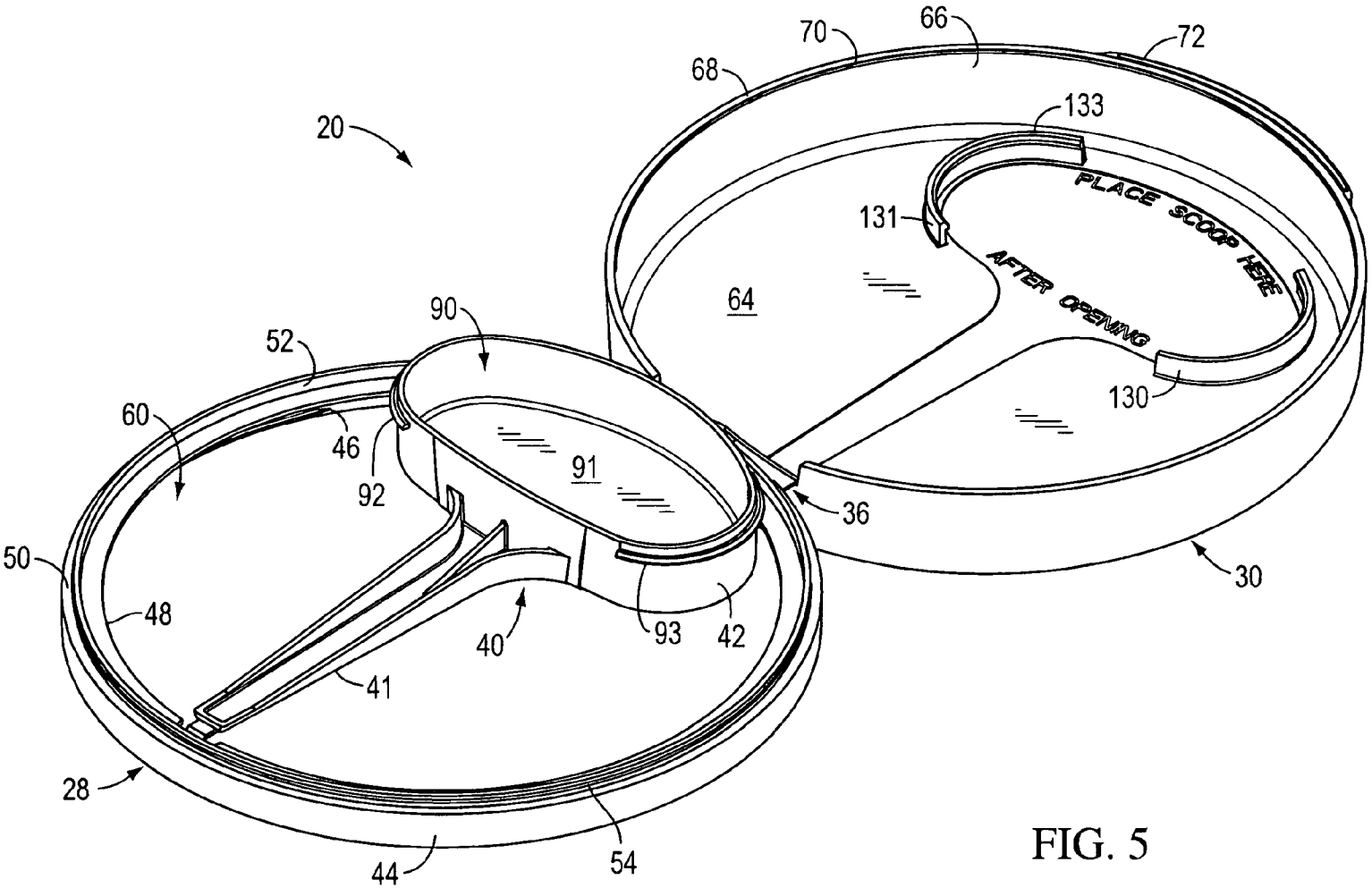
FIG. 5 is an isometric view of the closure shown in FIG. 4, but in FIG. 5 the closure is shown in the as-molded, open condition with the lid in the condition to expose the inside of the closure lid and the inside of the closure body.

With reference to FIG. 5, the hinge 36 may be of any suitable conventional or special design. For example, the hinge 36 illustrated in the Figures may be of a conventional snap-action type such as described in the U.S. Pat. No. 5,356,017 or U.S. Pat. No. 5,642,824, the details of which form no part of the present invention. The hinge could also be a non-snap-action type, including a strap or tether. However, preferably, the hinge 36 is molded unitary with closure body 28 and lid 30.

With reference to FIG. 5, closure 20 further includes utensil 40, which is initially molded integrally therewith. Utensil 40 includes handle portion 41 and utility portion 42. In the embodiment illustrated in FIGS. 1-22, utensil 40 is a handled scoop, and utility portion 42 is a scoop portion defining an open-ended receptacle. However, it is understood that other types of utensils could readily be implemented in accordance with other embodiments of the invention, such as a spoon, ladle, knife, fork, spear, or other structure, particularly those having an elongated handle. For example, in an embodiment featuring a fork utensil, the utility portion may include a plurality of fork tines, while in an embodiment featuring a knife utensil, the utility portion may include a cutting edge. Returning to the illustrated embodiment, scoop portion 42 includes opening 90, and bottom surface 91. Handle 41 is preferably connected to scoop portion 42 at a location that is proximate scoop bottom surface 91, and spaced vertically away from the plane of opening 90, for reasons described further herein below.

Scoop portion 42 further includes engagement beads 92 and 93 (FIG. 5), which permit subsequent securing of utensil 40 to closure top deck 64, as described in further detail below. In the illustrated embodiment, engagement beads 92 and 93 have an arcuate configuration, extending around a portion of the outer perimeter of utensil scoop portion 42, at an elevation preferably slightly offset from the plane of opening 90. However, it is contemplated that in alternative embodiments of the invention, differing numbers, shapes, positions and/or configurations of engagement beads could be provided.

Utensil 40 is initially molded unitary with the closure body 28, as illustrated in FIGS. 4-11. Utensil 40 includes frangible connections to closure body 28, thereby enabling manual separation of utensil 40 from closure body 28 by a user. Preferably, utensil 40 includes frangible connections to closure body 28 in two locations, thereby providing an interconnection with body 28 that is both stable, as well as readily separable with manual manipulation.

Figure 6:
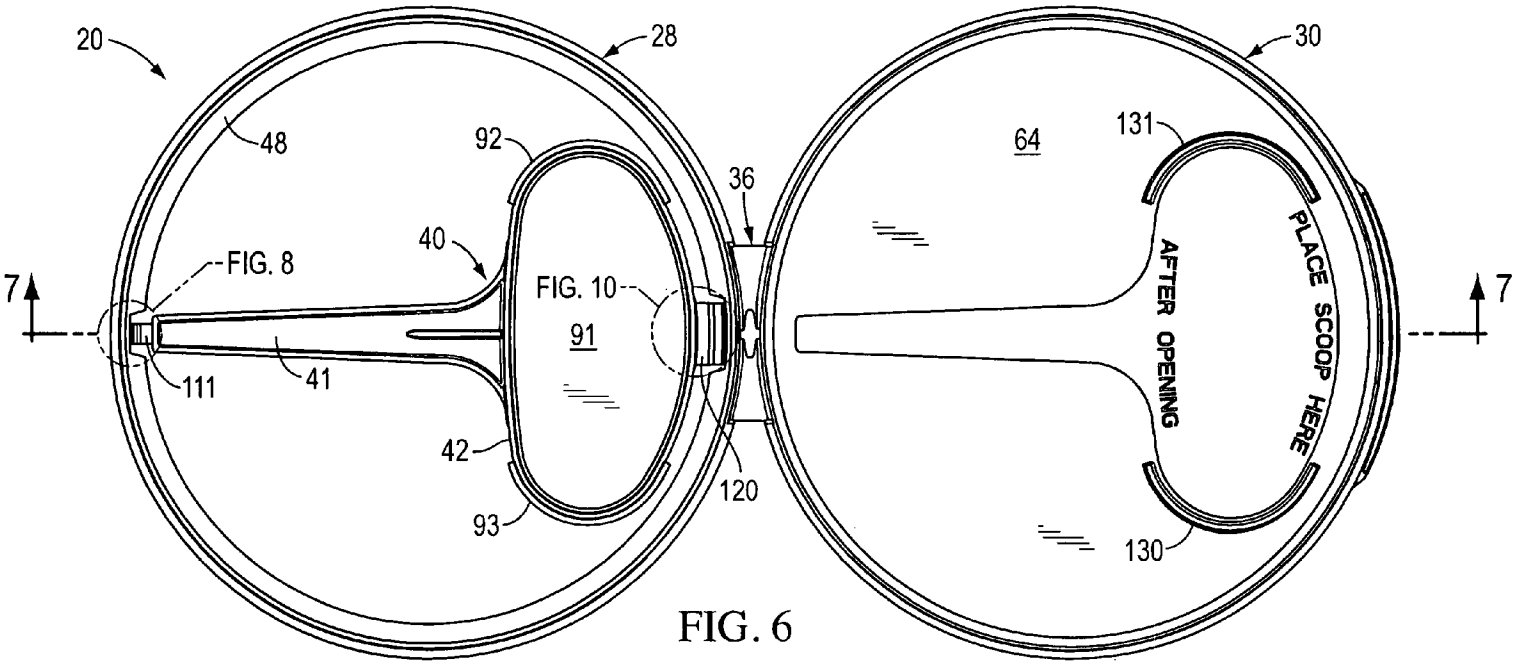
FIG. 6 is a plan view of the open closure shown in FIG. 5.
Figure 7:
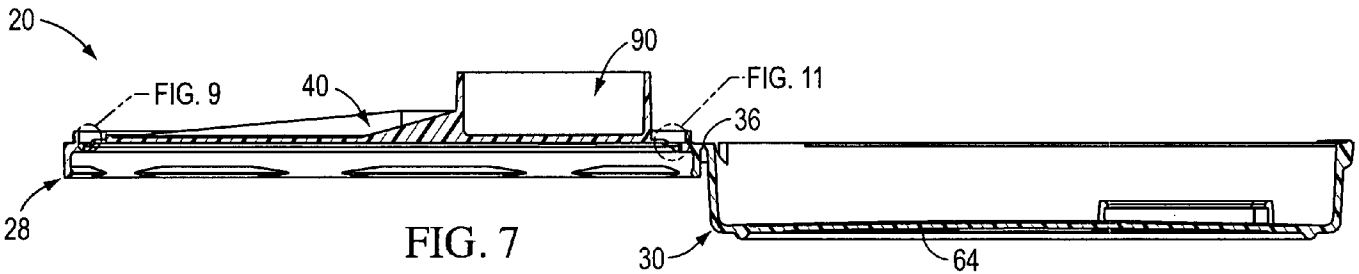
FIG. 7 is a cross-sectional view taken generally along the plane 7-7 in FIG. 6.
Figure 12:
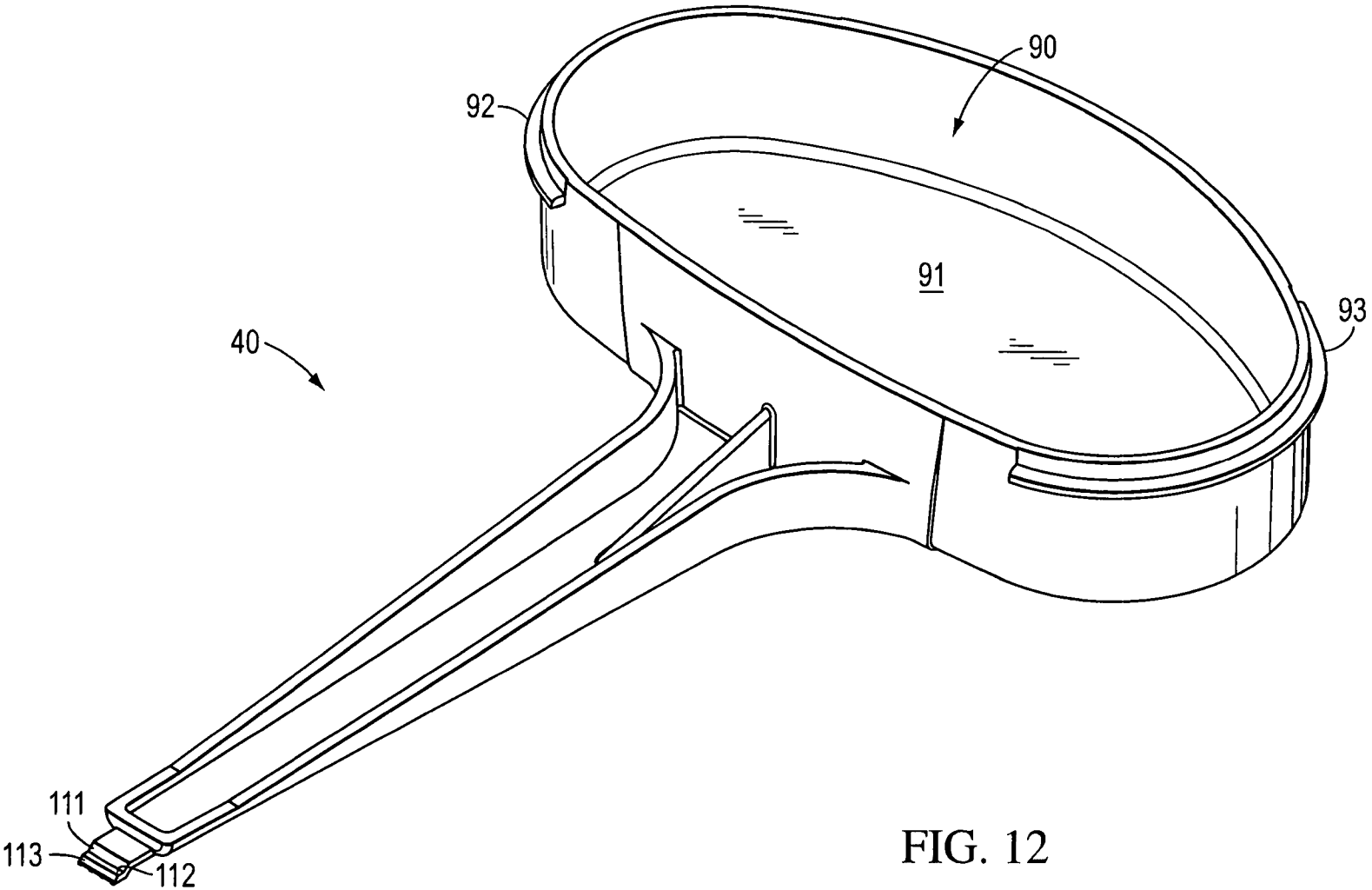
FIG. 12 is a greatly enlarged, isometric view of the utensil (i.e., a scoop with a handle) after it has been broken away from the closure body by the user after the user has opened the closure lid.
Figure 13:
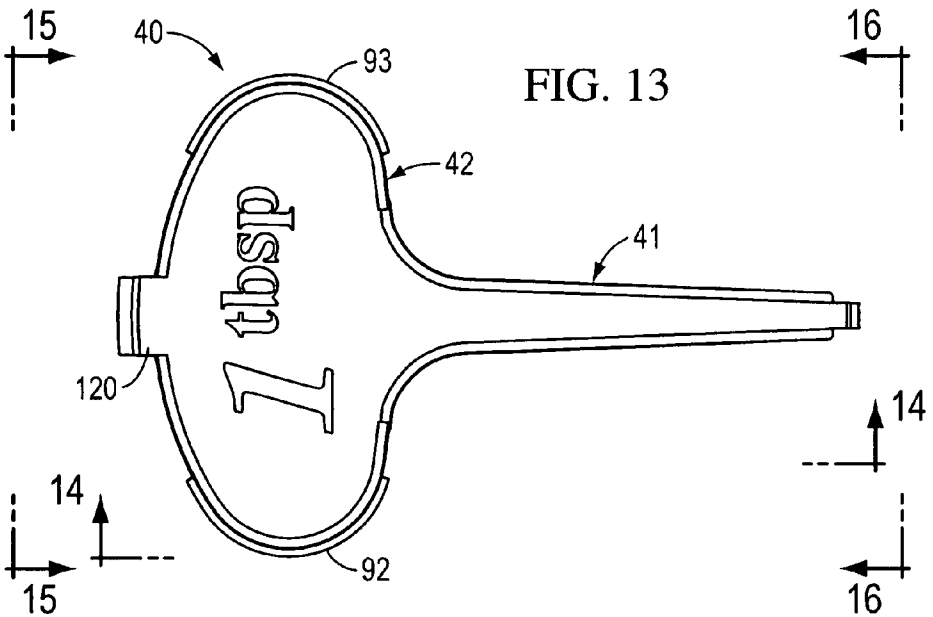
FIG. 13 is a bottom plan view of the utensil shown in FIG. 12.
Figure 14:
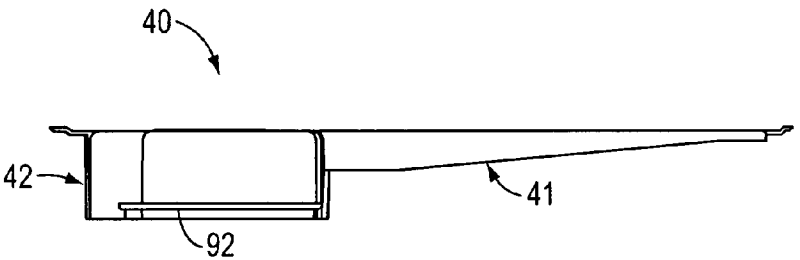
FIG. 14 is a side elevational view taken generally along the plane 14-14 in FIG. 13.
Figure 15:
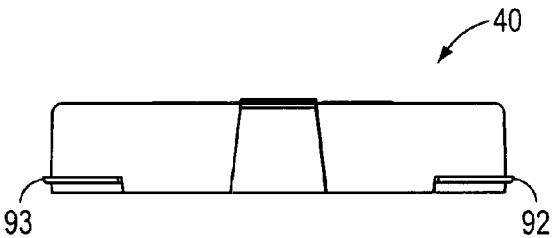
FIG. 15 is an end elevational view taken generally along the plane 15-15 in FIG. 13.
Figure 16:
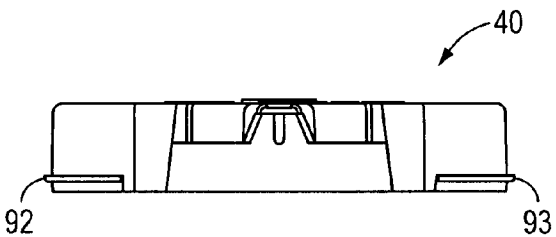
FIG. 16 is an end elevational view taken generally along the plane 16-16 in FIG. 13.

With reference to FIG. 6, a first frangible interconnection between utensil 40 and closure body 28 is provided at the end of utensil handle 41 opposite scoop portion 42, and the connection is illustrated in detail in FIGS. 8 and 9. The end of handle 41 is formed with a sloping extension 111 leading to lateral extension 112. Continuing towards rim 48, the thickness of handle 41 is reduced by slope 113. The slope 113 accommodates the steel of the mold used for molding the closure.

Sloping portion 113 is connected to rim 48 by a plurality of thin, frangible webs in the form of spaced-apart bridges 114 defining reduced cross-sectional thicknesses of material. In the illustrated embodiment, four frangible bridges 114 are provided. However, it is understood that a lesser or greater number of bridges could readily be implemented. By providing frangible bridges 114 recessed within notch 80, any residual, broken stubs or fragments of bridges 114 that may be created by the removal of utensil 40 remain recessed within notch 80, thereby reducing the likelihood of undesired user contact with such fragments during subsequent accessing by the user of the contents of the container 24.

With reference to FIG. 6, a second frangible connection between utensil 40 and closure body 28 is provided proximate scoop portion 42, and the connection is illustrated in detail in FIGS. 10 and 11. Utensil 40 includes a flange 120 extending laterally from a portion of scoop portion 42 proximate closed bottom portion 91, towards notch 82 in rim 48. Flange 120 further includes sloping extension 121 and lateral extension 122. Continuing towards rim 48, the thickness of flange 120 is reduced at slope 123, and connected to rim 48 by a plurality of frangible webs in the form of spaced-apart bridges 124 defining reduced cross-sectional thicknesses of the material. In the illustrated embodiment, six frangible bridges 124 are provided. However, it is understood that a lesser or greater number of bridges, having different dimensions, could readily be implemented. By providing frangible bridges 124 within notch 82, any residual, broken stubs or fragments of bridges 124 that are created by the removal of utensil 40 remain recessed within the notch 82, thereby reducing the likelihood of undesired user contact with such fragments during subsequent accessing by the user of the contents of the container 24.

Frangible bridges 114 and 124 facilitate the unitary molding of utensil 40 with closure 20, and preferably maintain utensil 40 in a desired position during initial installation of closure 20 on a container, and subsequent delivery of the container and closure to a recipient. However, upon application of twisting or other manual force to utensil 40, such as by an end user of a packaged product to which closure 20 is applied, frangible bridges 114 and 124 can be readily broken, thereby releasing utensil 40 from closure body 28. Once released, utensil 40 can be utilized, such as to remove, stir, or otherwise manipulate the contents of container 24.

It is presently preferred to provide two sets of frangible bridges to facilitate the molding and stability of utensil 40, while still enabling easy detachment of utensil 40 from the closure body 28 through the application of manual force. However, it is understood that fewer or greater numbers of frangible bridges can alternatively be employed.

By providing sloping extensions 111 and 121, the central longitudinal axis of utensil 40 is elevated from the utensil's points of attachment to rim 48. In some applications, it may be desirable to provide a foil or laminar seal across the mouth 26 of the container 24. By elevating the longitudinal axis of utensil 40 relative to its connection points with closure body 28, additional clearance can be provided between handle portion 41 and said seal, thereby enabling a user to better grip utensil 40 for detachment from closure body 28.

With utensil 40 positioned as molded and illustrated in FIGS. 4-11, closure 20 can be positioned alternatively in an open position (e.g., the position shown in FIG. 6) or a closed position (e.g., the position shown in FIG. 4). Thus, a manufacturer can mold the closure 20 in the open position, then close the closure lid 30, and then ship the closed closure 20 to a packager for installing the closed closure 20 on container 24 that has already been filled with product. Thereafter, the closed closure 20 can be subsequently opened by a consumer or other recipient. If the consumer desires to use utensil 40, then it can be broken away from closure body 28 through the application of manual force, causing the rupture of frangible bridges 114 and 124.

Figure 17:
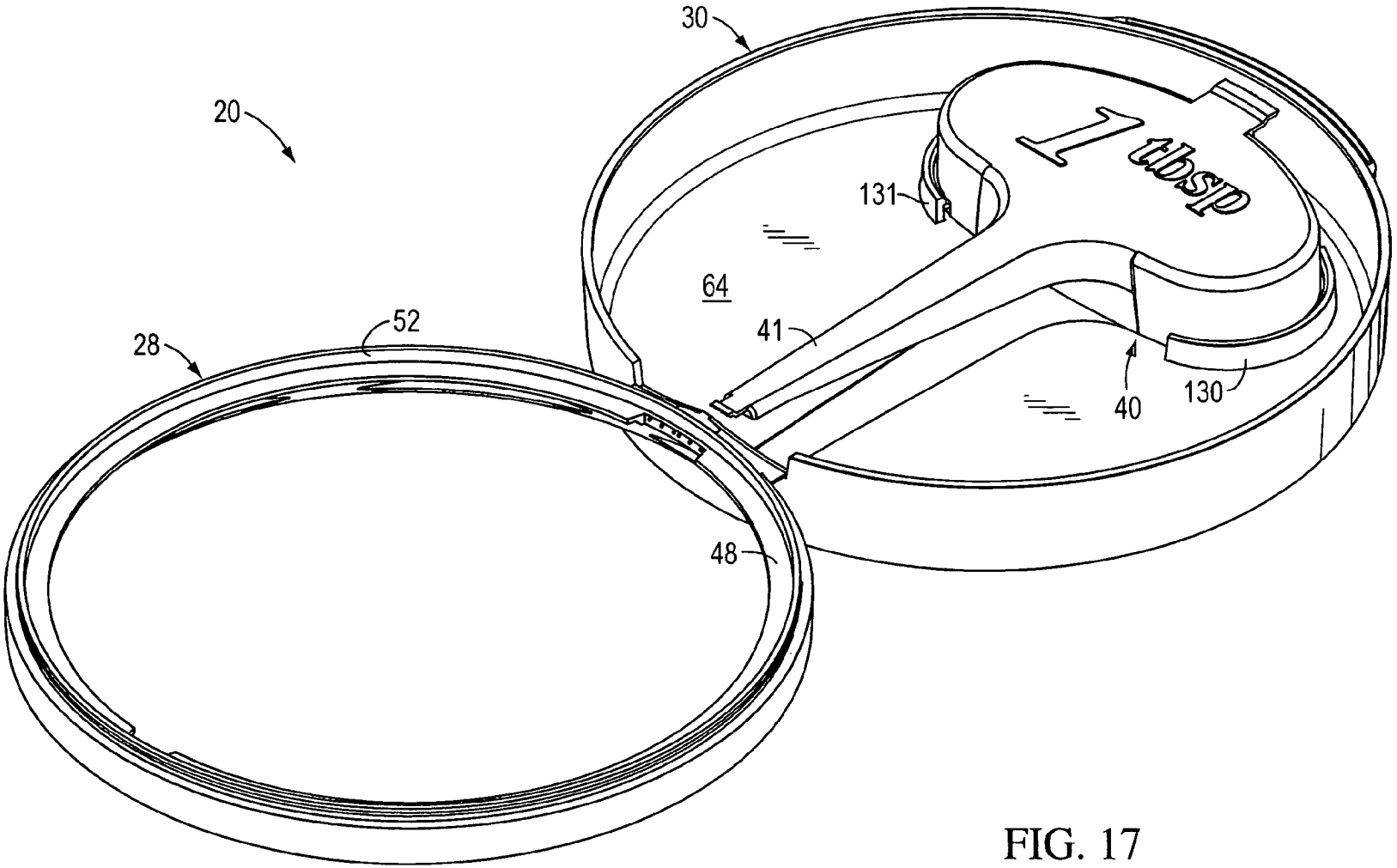
FIG. 17 is an isometric view similar to FIG. 5, but in FIG. 17, the utensil is shown after having been broken away from the closure body by the user and mounted to the underside of the opened closure lid.
Figure 18:
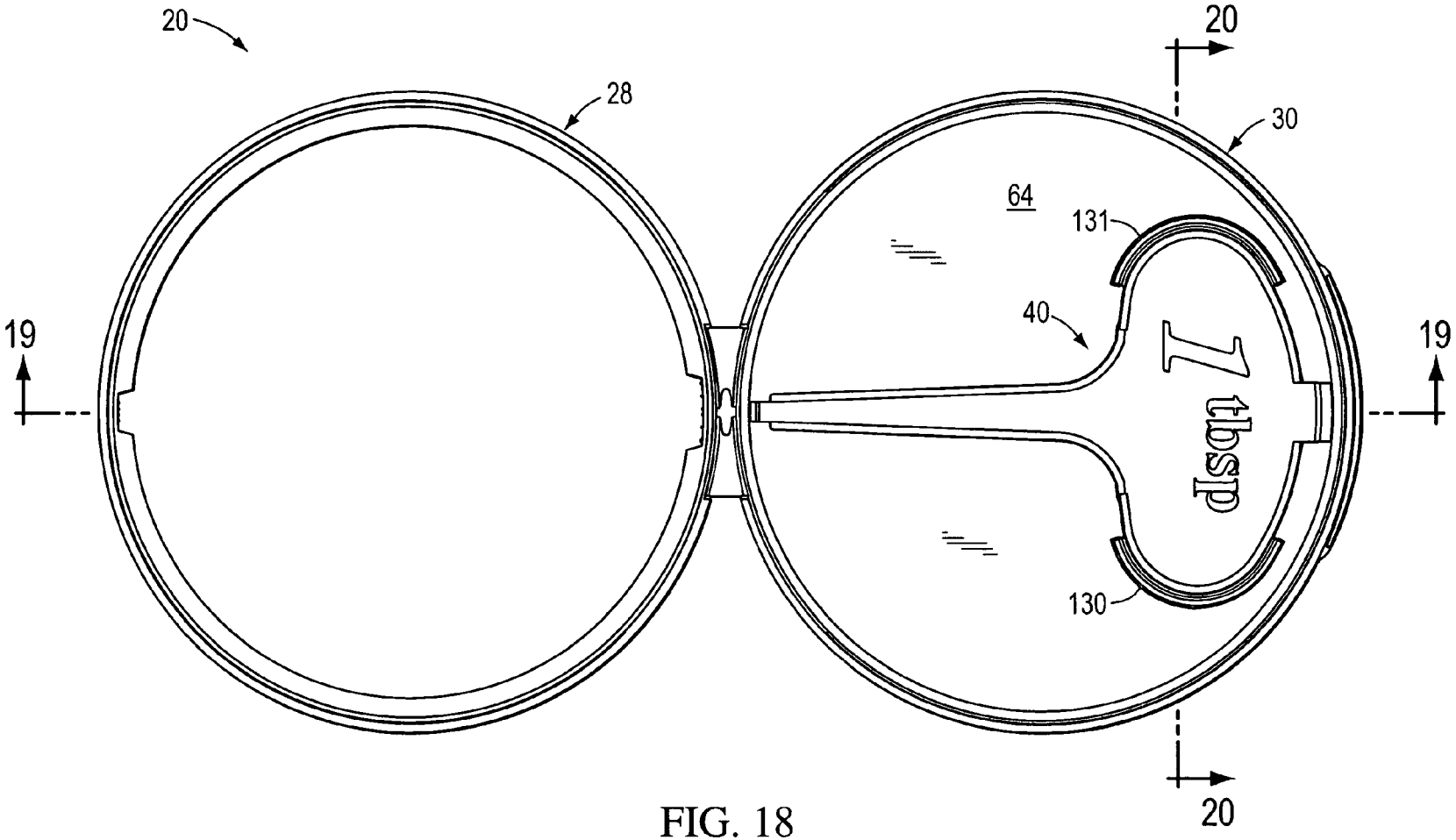
FIG. 18 is plan view of the components shown in FIG. 17.
Figure 19:
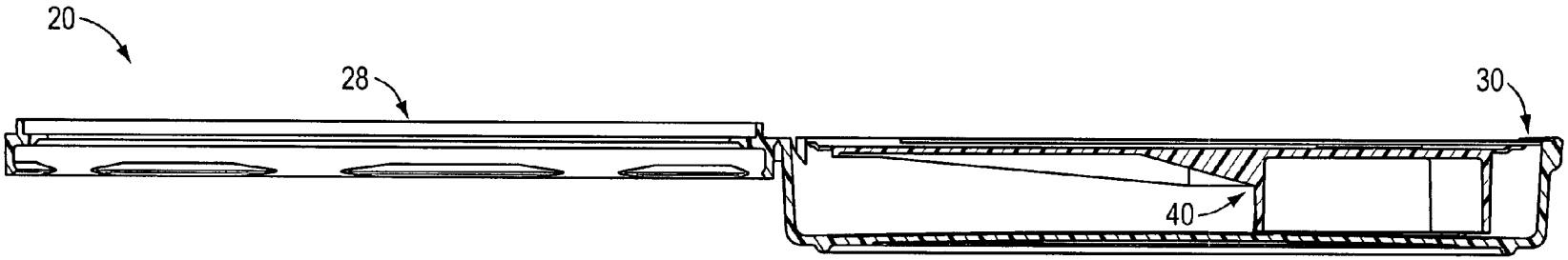
FIG. 19 is a cross-sectional view taken generally along the plane 19-19 in FIG. 18.
Figure 20:
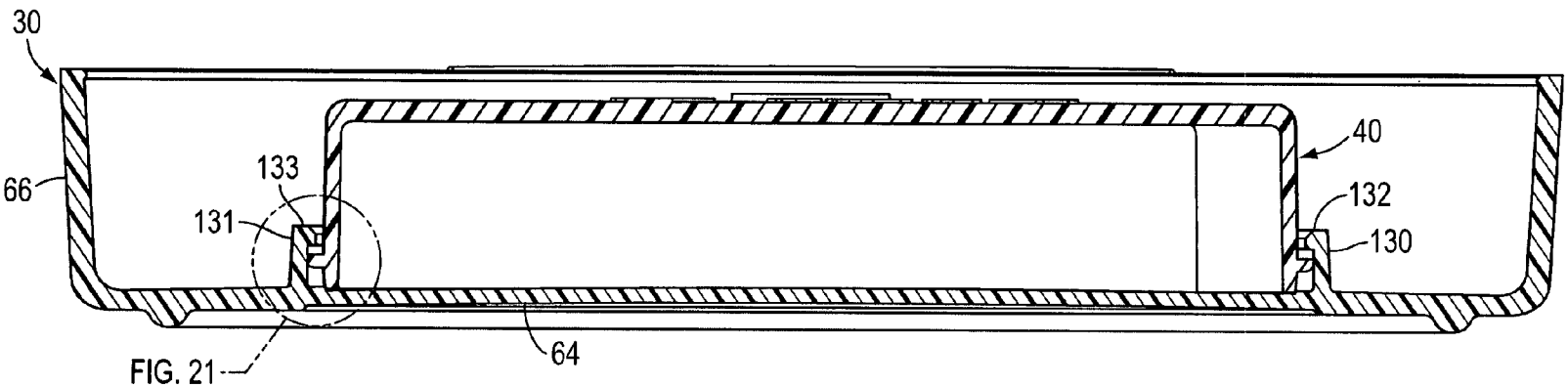
FIG. 20 is an enlarged, cross-sectional view taken generally along the plane 20-20 in FIG. 18.

FIGS. 12-16 provide views of utensil 40 in isolation, e.g., after utensil 40 is initially broken away and separated from closure 20. Once utensil 40 is initially broken away from closure 20 via rupture of frangible bridges 114 and 124, it can be subsequently remounted onto open closure lid 30 for storage between uses. FIG. 17 is an isometric view similar to FIG. 5, but in FIG. 17, the utensil (scoop) 40 is shown after having been broken away from the closure body and mounted by the user to the underside of closure lid top deck 64 which is illustrated in an open position. Further illustrating utensil 40 in a configuration in which it is releasably attached to top deck 64, FIG. 19 is a cross-sectional view taken generally along the plane 19-19 in FIG. 18. FIG. 20 is an enlarged, cross-sectional view taken generally along the plane 20-20 in FIG. 18.

As can be seen in FIGS. 5 and 6, lid top deck 64 has a utensil storage or receiving structure that includes snap rings 130 and 131, each of which is integrally molded with, and preferably extending perpendicularly from, top deck 64. In the illustrated embodiment, snap rings 130 and 131 have an arcuate configuration adapted to generally conform to portions of the perimeter of utensil scoop portion 42. Snap rings 130 and 131 include snap beads 132 and 133, respectively (see, e.g., FIGS. 20-21). Snap beads 132 and 133 are located on the inside surface of snap rings 130 and 131, and extend laterally to interact with utensil engagement beads 92 and 93, respectively, when utensil 40 is positioned within snap rings 130 and 131. Preferably, snap rings 130 and 131, and/or engagement beads 92 and 93 are configured for undergoing temporary elastic deformation while utensil 40 is moved towards and against closure lid 30, such that utensil engagement beads 92 and 93 can be manually forced between snap beads 132 and 133 and lid top deck 64, whereby utensil 40 is retained until sufficient force is later applied to utensil 40 to release utensil 40 by again temporarily, elastically deforming snap rings 130 and 131, and/or engagement beads 92 and 93.

Figure 21:
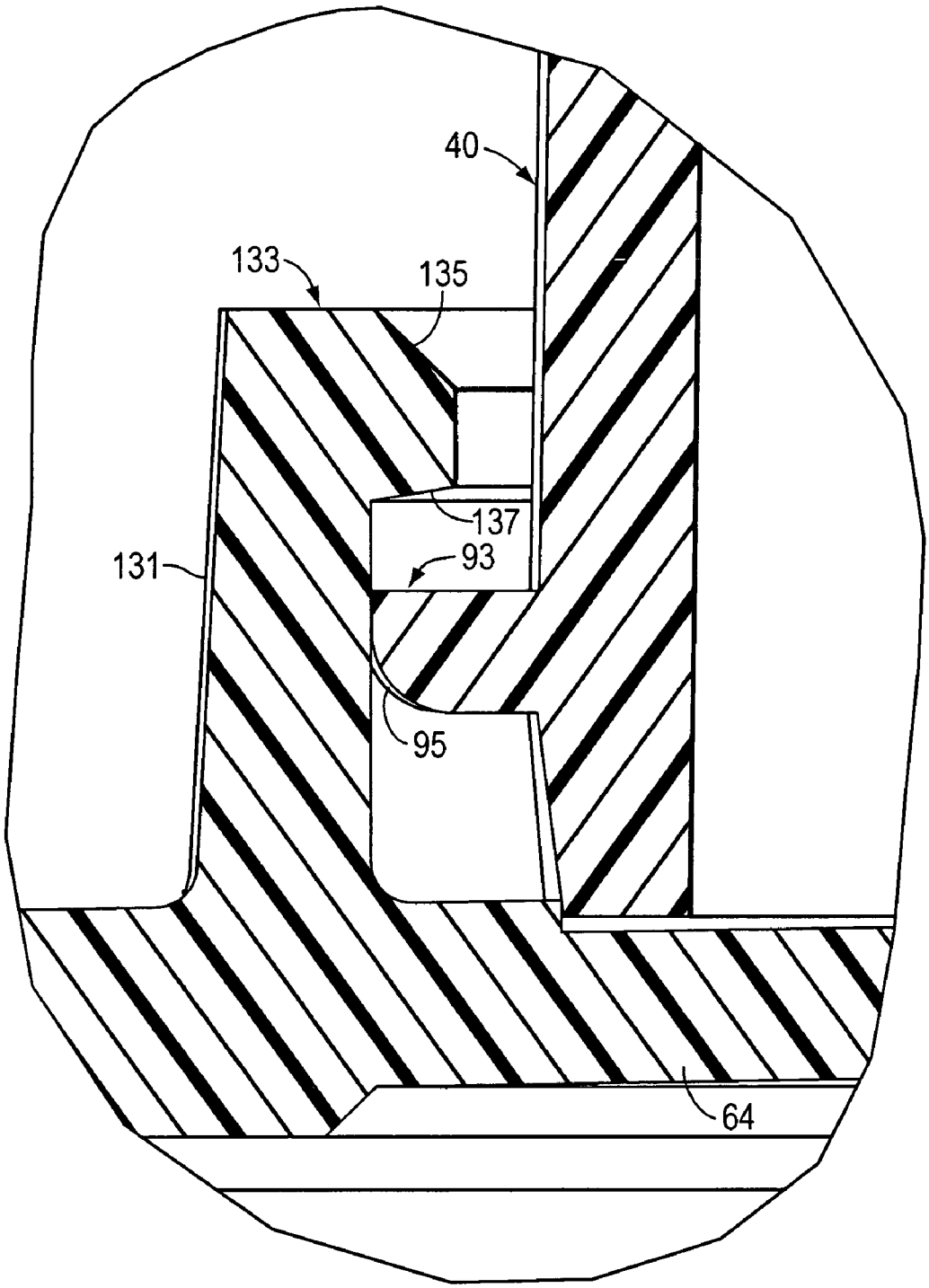
FIG. 21 is a greatly enlarged, fragmentary, cross-sectional view of a portion of the structure enclosed in the circle designated FIG. 21 in FIG. 20.

FIG. 21 is an enlarged, fragmentary cross-sectional view of a portion of the structure enclosed in the circle designated FIG. 21 in FIG. 20, further illustrating the structures of, and engagement between, snap ring 131, snap bead 133 and engagement bead 93. Snap bead 133 is integrally formed with snap ring 131, extending laterally therefrom towards utensil 40. Snap bead 133 includes angled surface 135, which is angled from the top surface of snap bead 133 towards closure top deck 64, to facilitate the movement of engagement bead 93 past snap bead 133 during movement of utensil 40 towards and against top deck 64. Snap bead 133 also includes lower angled surface 137, which forms the bottom of snap bead 133 and which is slightly angled away from closure deck 64, to facilitate temporary elastic deformation of engagement ring 93 and/or snap ring 131 during mounting of utensil 40 in the storage location on top deck 64. Similarly, engagement ring 93 includes curved surface 95, which further facilitates movement of engagement ring 93 past snap bead 133 during mounting of utensil 40 on top deck 64. While not illustrated in enlarged fragmentary cross-sectional view, the structures of snap ring 130, snap bead 132, and engagement bead 92 are analogous to those illustrated in FIG. 21.

While the receiving structure snap rings 130 and 131 are generally arcuate as illustrated, it is contemplated that in alternative embodiments of the invention, differing numbers, shapes, positions and/or configurations of retaining structures can be alternatively employed, towards providing alternative structures for removably securing utensil 40 to closure top deck 64.

Because utensil handle portion 41 connects with scoop portion 42 at a level approximately coincident with the plane of scoop bottom surface 91, and offset from the plane of scoop opening 90, handle portion 41 is maintained in a position spaced away from lid top deck 64 when utensil 40 is mounted to lid 30. Maintaining handle portion 41 in such a spaced-away position relative to the lid 30 can significantly facilitate subsequent removal of utensil 40, because a user's fingers may be better able to wrap partially or completely around handle portion 41 to grip the utensil.

Figure 22:
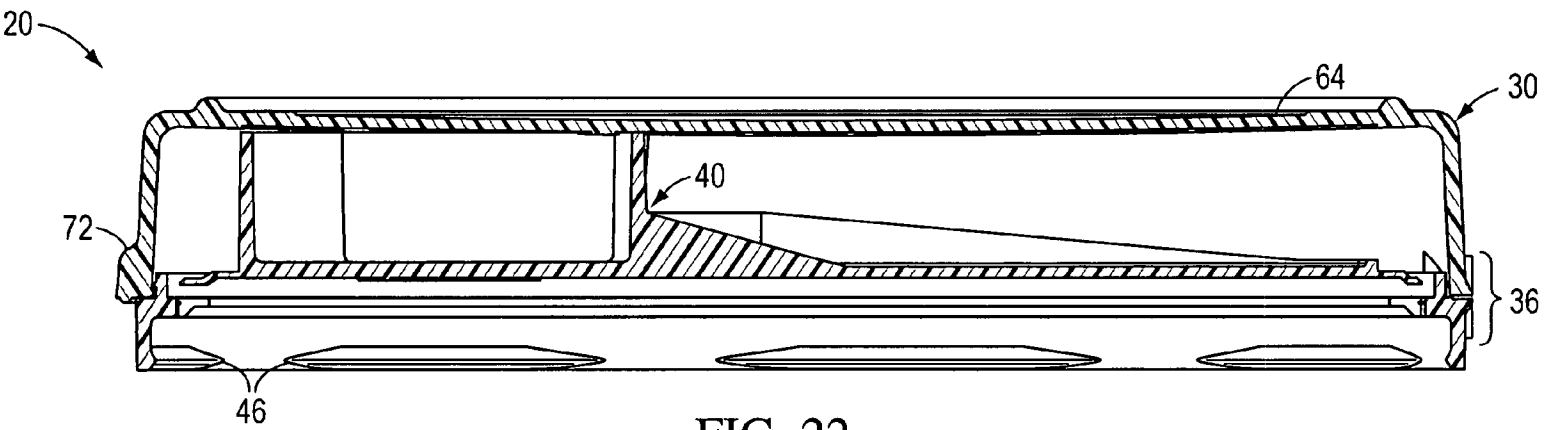
FIG. 22 (on the drawing sheet 3/23 with FIG. 4) is a cross-sectional view similar to FIG. 4, but in FIG. 22 the utensil is mounted in the underside of the lid after the user has initially opened the closure, removed the utensil from the closure body, inserted the utensil into the opened closure lid, and then closed the lid back over the closure body with the utensil mounted in the closure lid.

After utensil 40 is releasably attached to, and stored on, top deck 64 via engagement of snap rings 130 and 131 with engagement rings 92 and 93, respectively, closure 20 can be closed by pivoting of lid 30 relative to closure body 28, about hinge 36. FIG. 22 illustrates a cross-sectional view of closure 20 in such a closed configuration, with utensil 40 mounted on closure lid 30.

Figure 23:
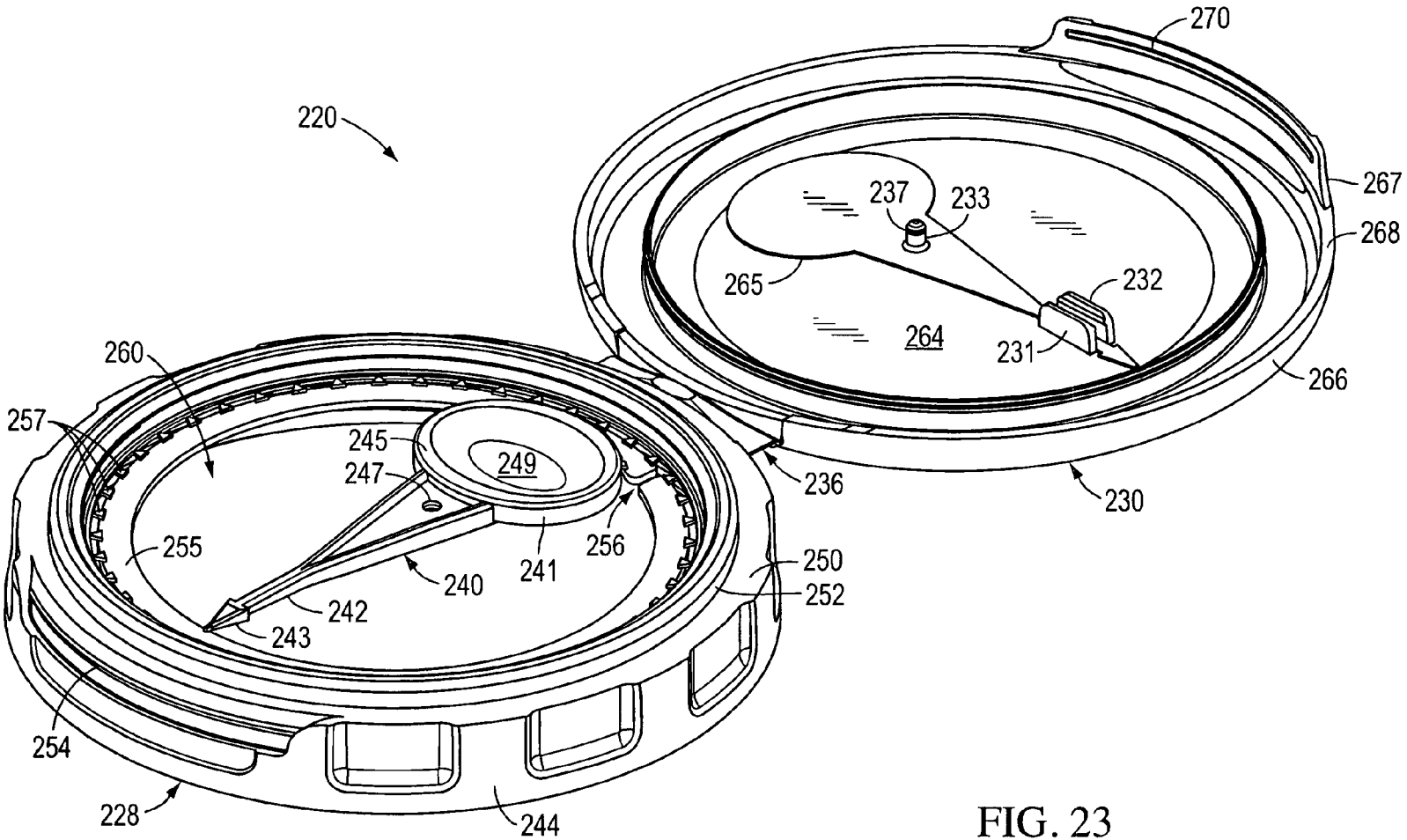
FIG. 23 is an isometric view of a second embodiment of the closure of the present invention.

FIGS. 23-39 illustrate a second embodiment of the present invention. With reference to FIG. 23, closure 220 includes a peripheral wall, base, or body 228 and a lid 230. The body 228 is joined to the lid 230 by a hinge 236. The closure body 228 initially holds a product spear type of utensil 240, in a manner that permits the utensil 240 to be subsequently detached from the body 228 by the user and utilized for removal of products, such as pickles or olives, from a container to which closure 220 is attached.

In the embodiment of FIG. 23, the closure 220 is initially molded in the open condition as a separate article that is subsequently closed (FIGS. 30 and 31) and then installed on a container (not illustrated) after the container has been filled with product. The closure body 228 has a depending skirt 244 having internal screw threads 246 (FIG. 25) for releasable engagement with mating screw threads formed on the outside surface of a container to which the closure 220 is applied. However, as with the first embodiment closure 20 shown in FIG. 1, it is contemplated that alternative means of attaching the closure 220 to a container could also be employed (e.g., snap-fit).

The closure body 228 has an exterior peripheral shoulder 250 at the upper portion of skirt 244, and also has a generally annular neck or wall 252 projecting upwardly from the inner diameter of the shoulder 250. The closure body 228 also has an interior annular wall 251 (FIG. 26), which curves inwards and downwards from the top of annular wall 252. A flange or rim 248 (FIGS. 24, 26, and 27) extends inwardly from interior annular wall 251.

The closure body 228 has an opening 260 (FIG. 23) defined by interior annular wall 251. The opening 260 is adapted to be covered by the lid 230. The lid 230 includes a top deck or cover 264 (FIGS. 23 and 31) substantially surrounded by a peripheral flange 266 having an end surface 268 for confronting and abutting, the closure body shoulder 250 when the lid 230 is closed. The lid flange 266 includes an extension 267 having an inwardly projecting latch bead 270 (FIG. 23). On the closure body 228 there is a latch bead 254 (FIG. 23) which is located on the periphery of the portion of the closure body skirt 244 located opposite the hinge 236, and which projects outwardly from the skirt 244 at an elevation below the shoulder 250. When the lid 230 is closed on the body 228, the upwardly facing surface of the lid latch bead 270 is below, and is positioned to engage, the downwardly facing surface of the overlying closure body latch bead 254. The body wall 244 and/or the lid flange extension 267 are sufficiently flexible to accommodate temporary, elastic deformation as the beads 254 and 270 move past each other during the opening and closing actions. To open the lid 230, the user pushes or pulls upwardly on the bottom of lid flange extension 267 with a thumb or finger. Other conventional or special latch designs could be used instead.

Closure 220 further includes utensil 240 (FIG. 23), which is initially molded integrally therewith. Utensil 240 includes handle portion 241 and utility portion 242. In the illustrated embodiment, utensil 240 is a product spear, adapted for spearing and removal of products (e.g., pickles or olives) from a container. Utility portion 242 is an elongated shaft having a pointed barbed end 243. Handle portion 241 is a thin, relatively broad structure having a perimeter generally in the shape of a conic section. Handle portion 241 includes peripheral ridge 245, providing an area of increased thickness relative to utility portion 242. Handle portion 241 further includes central depression 249, providing an area of reduced thickness relative to peripheral ridge 245, thereby providing a location that can be readily gripped by a user's finger.

Utility portion 242 also includes mounting aperture 247, which permits subsequent securing of utensil 240 to closure top deck 264, as described in further detail below.

Figure 33:
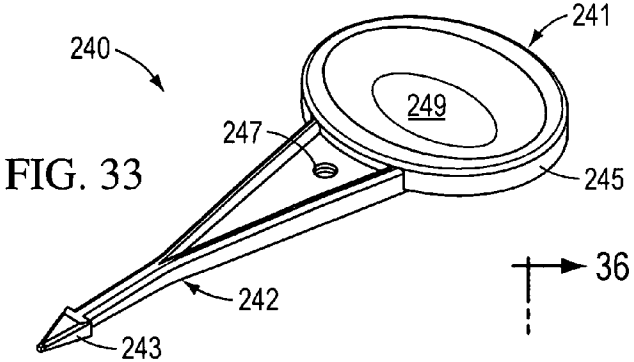
FIG. 33 is an isometric view of the utensil shown in FIG. 32, after the utensil has been broken away from the release ring.
Figure 34:
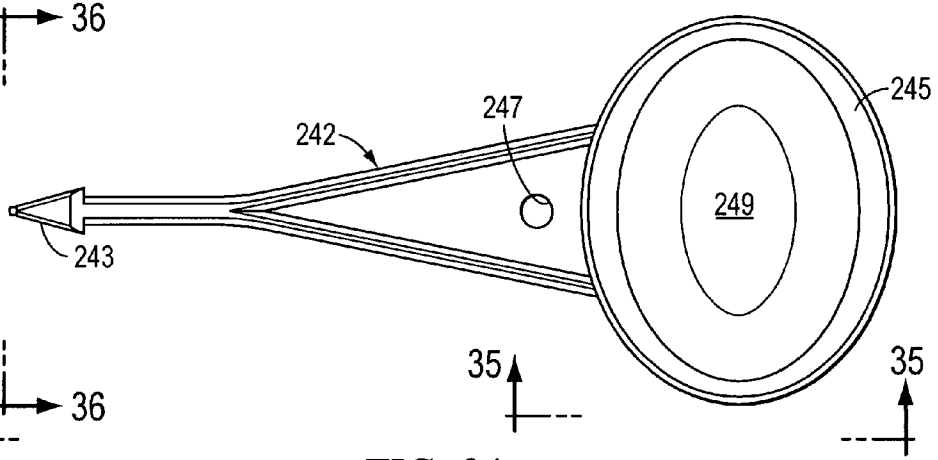
FIG. 34 is a top plan view of the utensil shown in FIG. 33.
Figure 35:
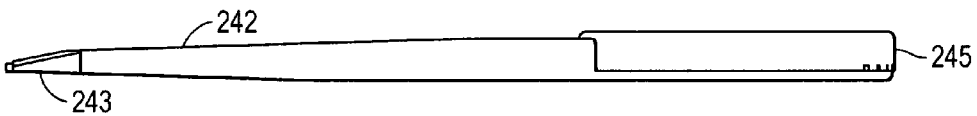
FIG. 35 is a side elevational view of the utensil shown in FIG. 34, taken generally along the plane 35-35 in FIG. 34.
Figure 36:
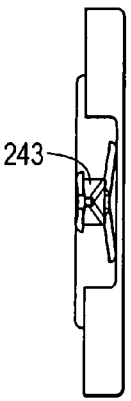
FIG. 36 is an end elevational view of the utensil shown in FIG. 34, taken generally along the plane 36-36 in FIG. 34.

Utensil 240 is illustrated in isolation in FIGS. 33-35, in which FIG. 33 provides an isometric view. While certain preferred structures for utensil 240 are described herein and shown in the drawings, it is contemplated that in alternative embodiments of the invention, different utensils and structures could readily be employed.

As illustrated in FIGS. 23-31, utensil 240 is initially molded unitary with an internal, arcuate member or release ring 255, which together with utensil 240 is molded unitary with the closure body 228. Utensil 240 includes frangible connections to release ring 255, thereby enabling manual separation of utensil 240 from release ring 255 by a user. Preferably, utensil 240 includes frangible connections to release ring 255 in two locations (i.e., frangible bridges 214 and 224 in FIGS. 24, 27, and 29), thereby providing an interconnection with release ring 255 that is both stable, as well as readily broken or separable when the utensil 240 is subjected to manual manipulation. In the preferred embodiment shown in FIG. 29, the frangible bridges 224 have partially triangular shapes as viewed in plan from above.

Release ring 255 extends around the interior edge of rim 248, with a plurality of spaced-apart frangible bridges 257 (FIGS. 23 and 24) extending between release ring 255 and closure body inner rim 248 to provide an interconnection with body 228 that is stable, yet readily susceptible to a continuous tearing motion for manual separation of release ring 255 from body 228. In some prior art closures not having an integrally molded utensil, ring structures similar to release ring 255 are sometimes referred to as "BAPCO style" closures. Such prior art BAPCO style closures are described in, for example, international PCT patent application Publication WO 99/61337. BAPCO style closures can facilitate the removal of a foil seal configured to span a container mouth (such a foil seal is not illustrated and forms no necessary part of the present invention).

Figure 24:
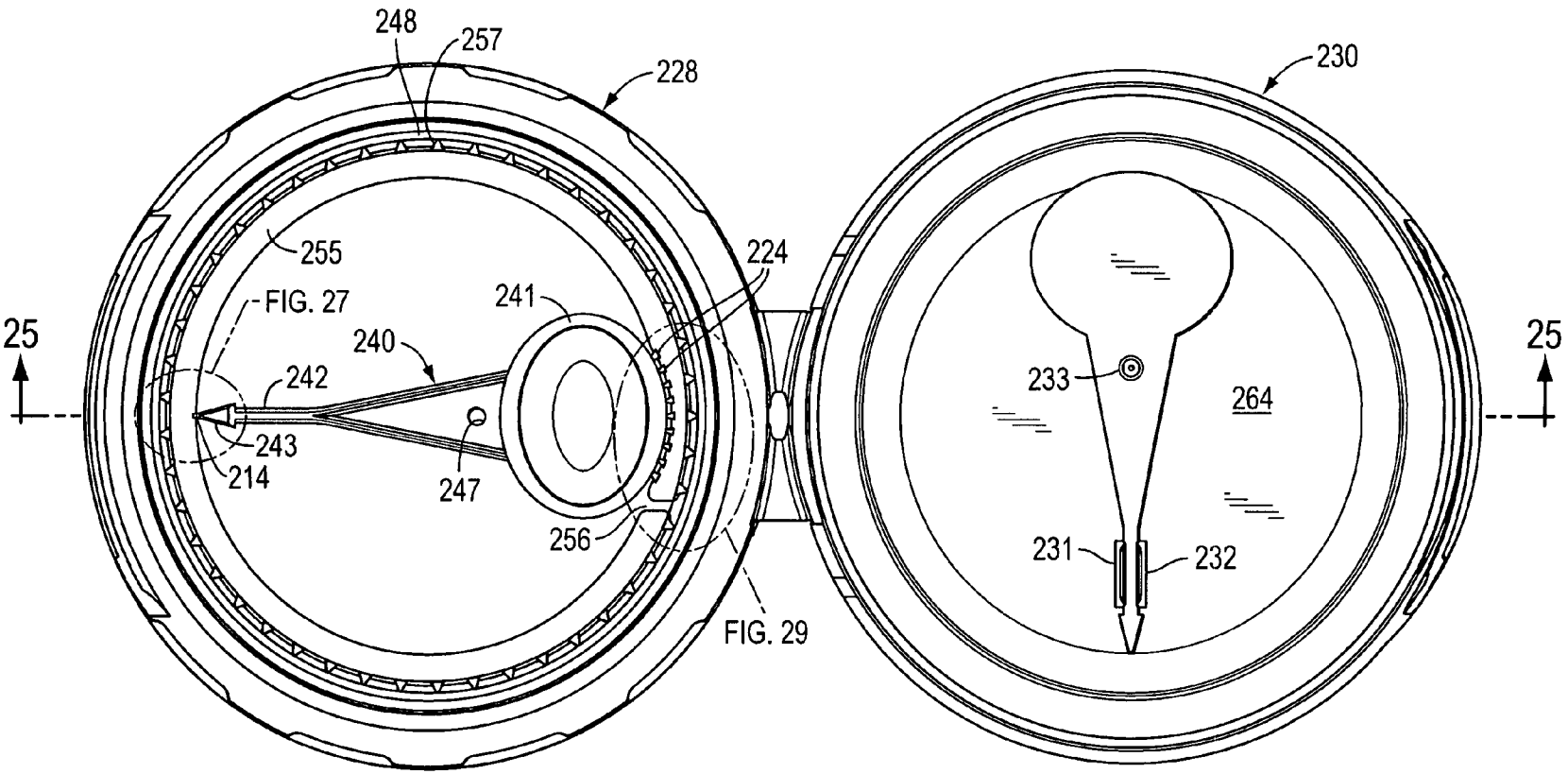
FIG. 24 is a plan view of the open closure shown in FIG. 23.
Figure 25:
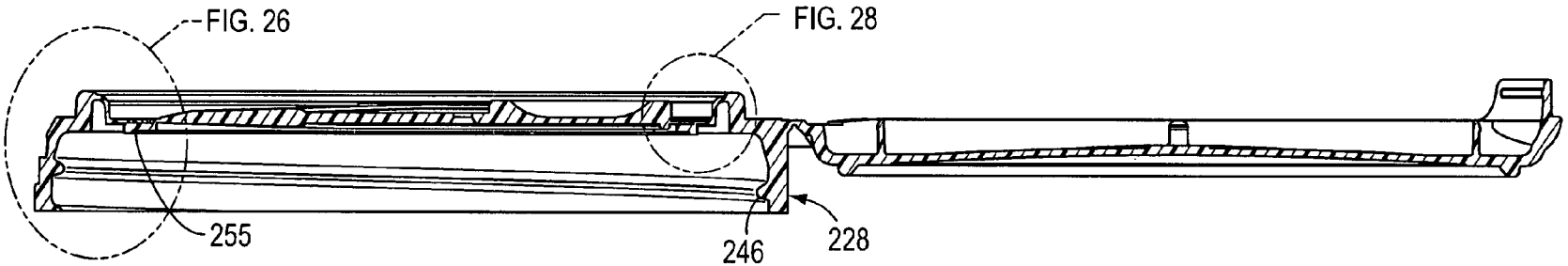
FIG. 25 is a cross-sectional view taken generally along the plane 25-25 in FIG. 24.
Figure 26:
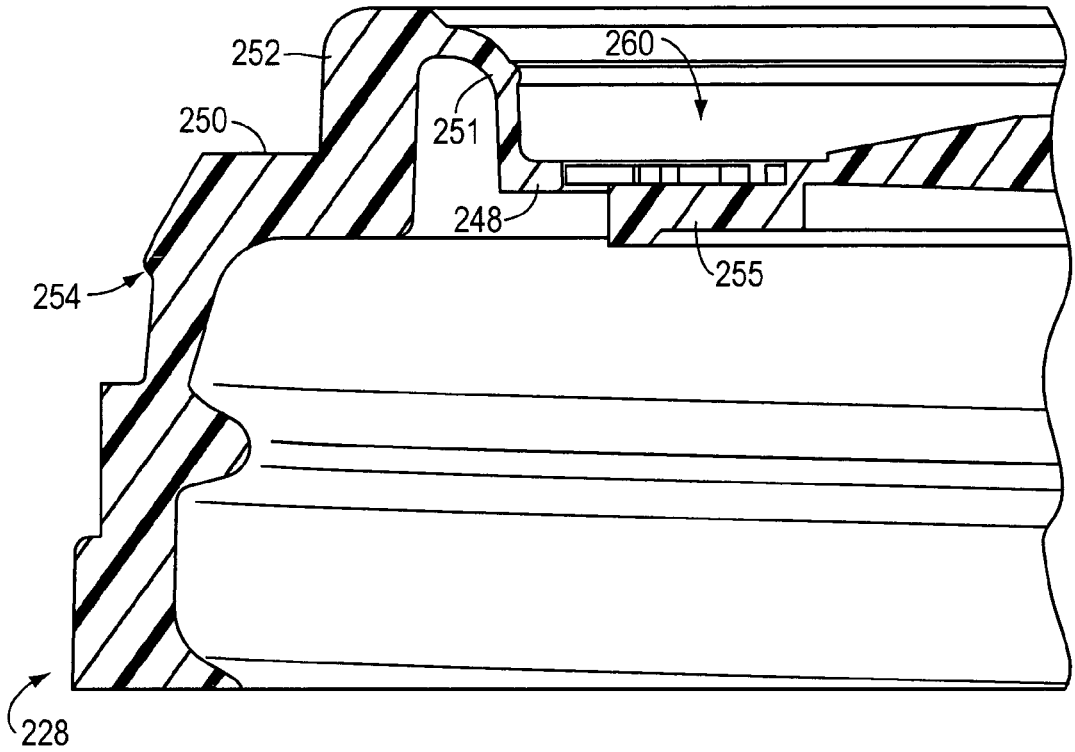
FIG. 26 is a greatly enlarged, fragmentary, cross-sectional view of a portion of the structure enclosed within the circle designated FIG. 26 in FIG. 25.
Figure 27:
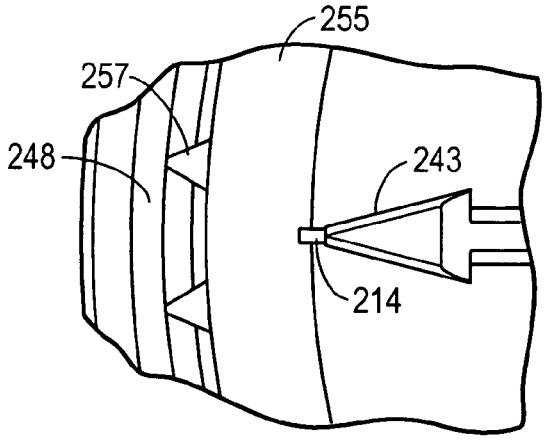
FIG. 27 is a greatly enlarged, fragmentary, plan view of a portion of the structure enclosed within the circle designated FIG. 27 in FIG. 24.
Figure 30:
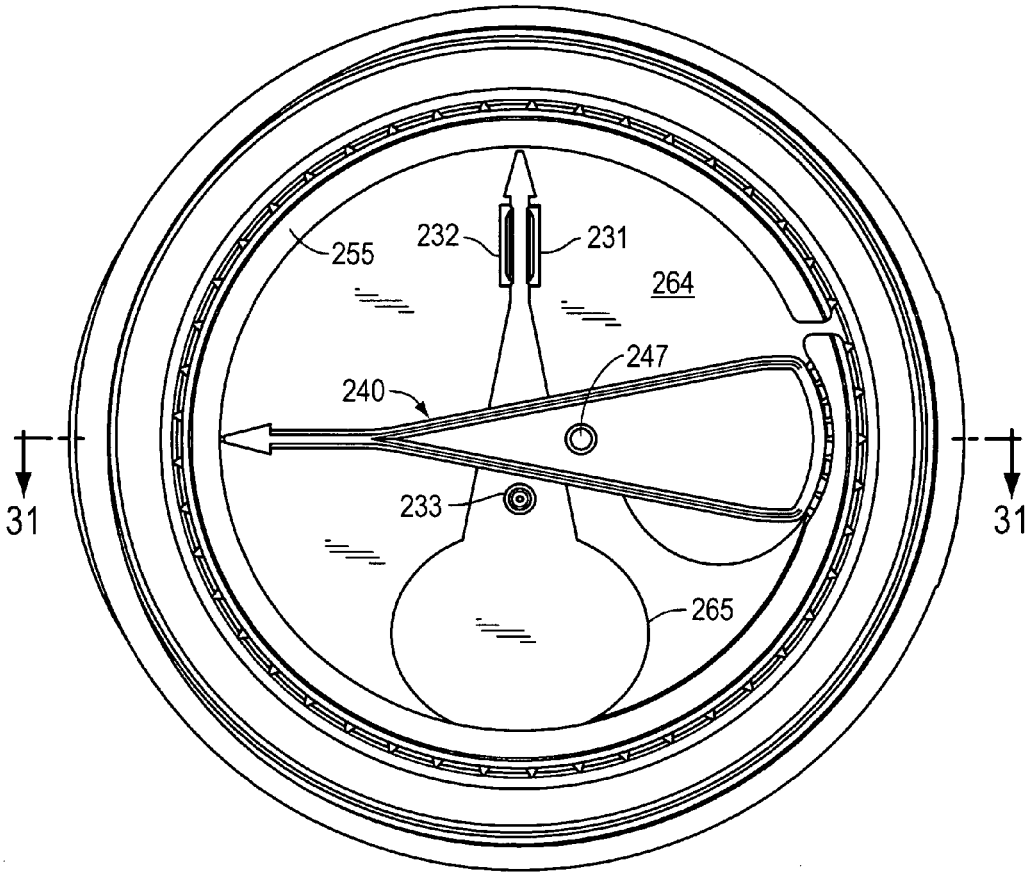
FIG. 30 is a bottom plan view of the closure shown in FIG. 23, but FIG. 30 shows the closure after the lid has been placed into a closed position.
Figure 31:
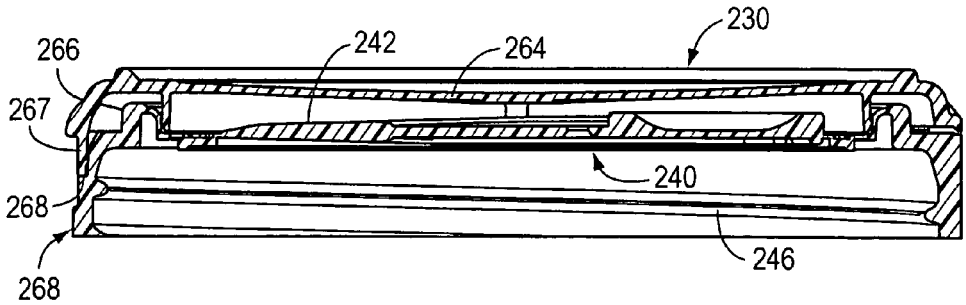
FIG. 31 is a cross-sectional view taken generally along the plane 31-31 in FIG. 30.
Figure 32:
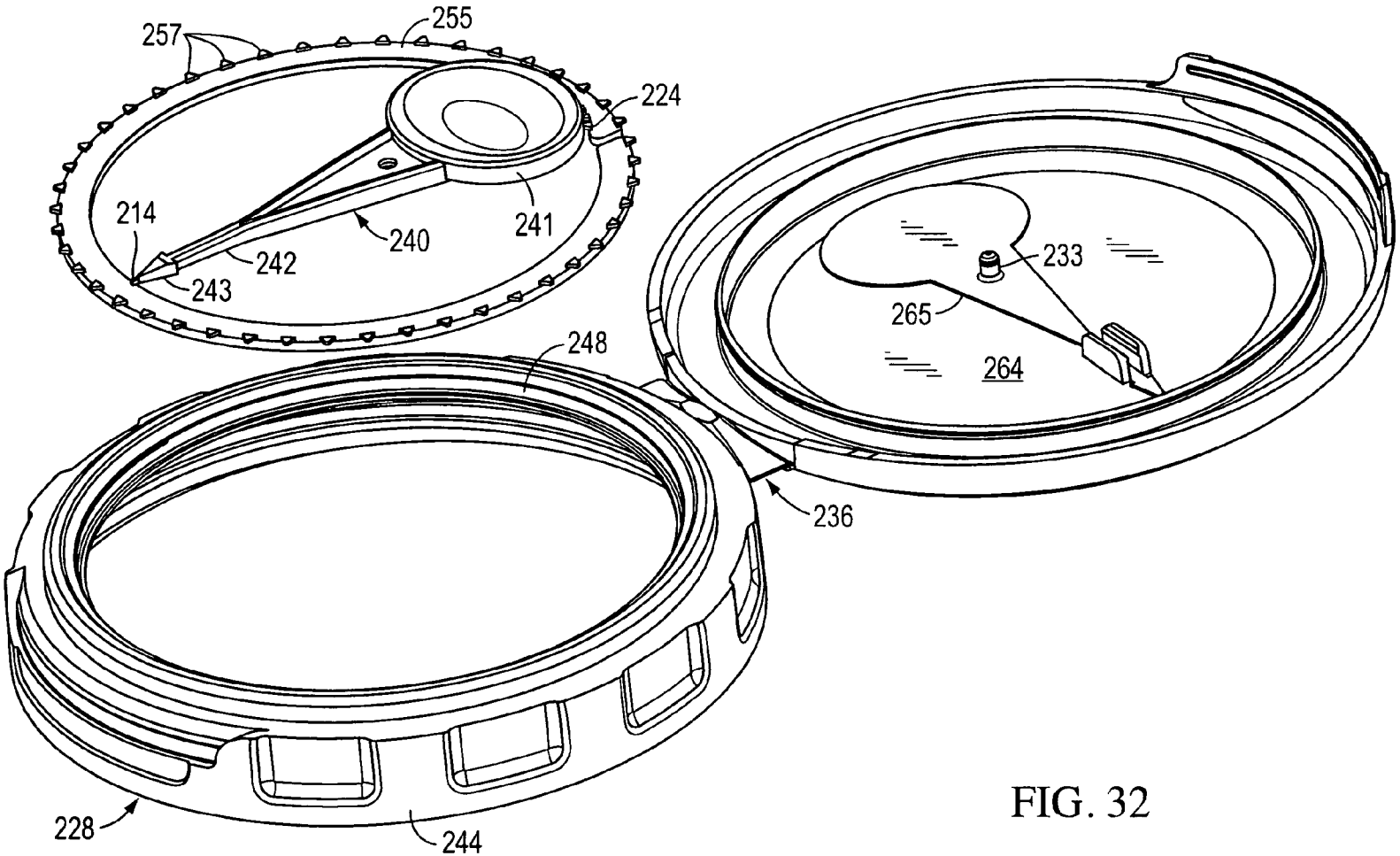
FIG. 32 is an isometric view similar to FIG. 23, but in FIG. 32, the utensil (i.e., product spear) is shown attached to a release ring which has been broken away from the closure body.

Release ring 255 preferably extends continuously around the interior of rim 248, with the exception of gap 256 (FIG. 24). By providing gap 256, release ring 255 can be more easily separated from closure body 228 via the application of upward pulling on release ring 255 and/or utensil 240, particularly handle portion 241 of utensil 240. FIG. 32 illustrates release ring 255 and utensil 240 after release ring 255 has been separated from rim 248 through rupturing of frangible bridges 257.

Figure 37:
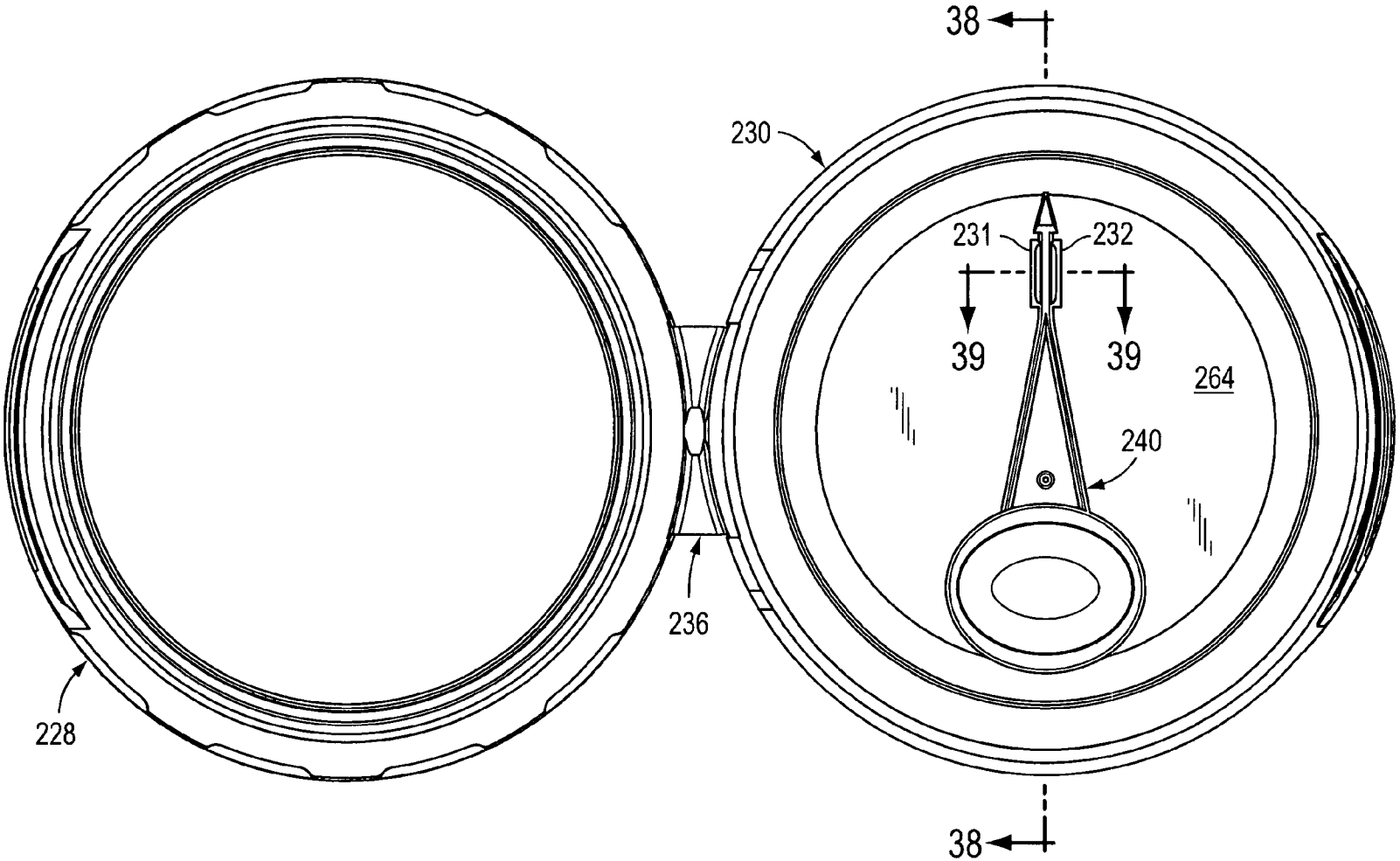
FIG. 37 is a top plan view similar to FIG. 24, but in FIG. 37 the utensil is shown after the release ring has been broken away from the closure body, and after the utensil has been broken away from the release ring and mounted to the underside of the opened closure lid.
Figure 38:
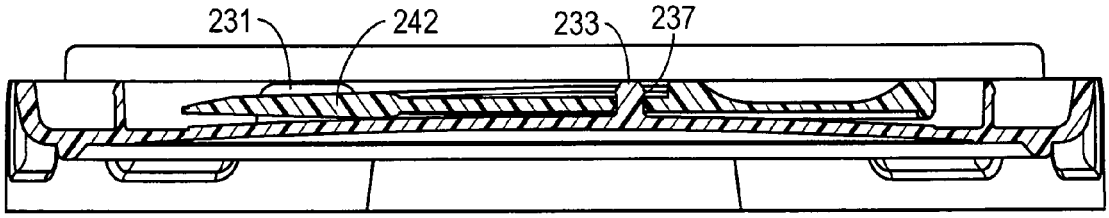
FIG. 38 is an enlarged, cross-sectional view taken generally along the plane 38-38 in FIG. 37.

Utensil 240 can be separated from release ring 255 through rupturing of frangible bridges 214 and 224, thereby freeing utensil 240 for use. Utensil 240 can be subsequently mounted within closure 220, such as for storage between uses. FIG. 37 is a top plan view of closure 220 similar to FIG. 24, but in FIG. 37, release ring 255 is not shown because it has been broken away from closure body 228 and discarded after the utensil 240 has been broken away from release ring 255 and mounted to the underside of closure lid top deck 264 which is illustrated in an open position. In the embodiment shown in FIG. 23, top deck 264 includes indicia 265 having the general shape and outline of a top plan view of utensil 240. Accordingly, indicia 265 provides a visual cue alerting users to the proper orientation for securing utensil 240 to top deck 264. It is contemplated that indicia 265 could be formed from any of a variety of structures, such as a molded portion of top deck 264 that is elevated relative to surrounding portions, a portion of top deck 264 that is depressed relative to surrounding portions, an elevated rib extending from top deck 264, or a groove depression within top deck 264. The indicia 265 could also be a printed area, or an adhesively secured label, etc.

Figure 39:
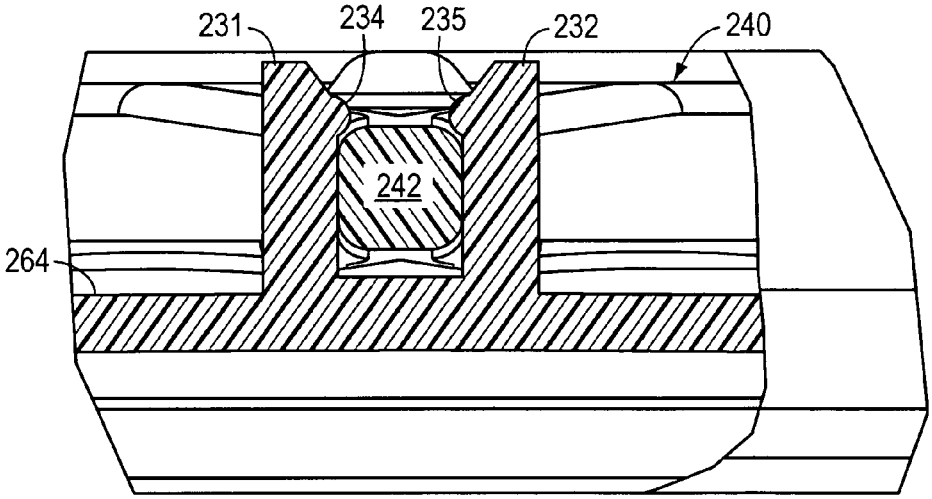
FIG. 39 is a greatly enlarged, fragmentary, cross-sectional view taken generally along the plane 39-39 in FIG. 37.

Lid top deck 264 has a utensil-receiving structure (i.e., storage structure) that includes snap ribs 231 and 232 (FIGS. 24, 37, and 39), each of which is integrally molded with, and preferably extending perpendicularly from, top deck 264. In the illustrated embodiment, snap ribs 231 and 232 have a linear configuration adapted to generally conform to the sides of utensil elongated shaft 242. Snap ribs 231 and 232 include snap beads 234 and 235, respectively (FIG. 39). Preferably, snap ribs 231 and 232 are configured to accommodate deformation while utensil 240 is moved against closure lid 230, such that utensil shaft 242 can be manually forced between snap beads 234 and 235, and lid top deck 264, thereby acting to retain utensil 240 until sufficient force is applied to pull utensil 240 away from lid top deck 264 to release utensil 240 by again deforming snap ribs 231 and 232.

Lid top deck 264 also includes mounting post 233 (FIGS. 23 and 38) which can further act to retain utensil 240 against top deck 264. In the illustrated embodiment, mounting post 233 is formed as a cylindrical structure extending perpendicularly from top deck 264. Mounting post 233 is adapted to enter into utensil mounting aperture 247. The distal end of mounting post 233 includes snap bead 237 (FIGS. 23 and 38) extending around its circumference to further enhance engagement of utensil 240 with post 233. Preferably, the plastic material defining utensil mounting aperture 247 undergoes temporary elastic deformation when utensil 240 is moved against closure lid 230, such that aperture 247 temporarily expands to allow snap bead 237 to be forced through aperture 247, after which snap bead 237 subsequently engages the outwardly facing surface of utensil 240 proximate the edge of aperture 247 to inhibit subsequent movement of utensil 240 away from top deck 264.

The utensil 40 described above with respect to the first embodiment of the closure 20 illustrated in FIGS. 1-22 may be employed, with the appropriate modifications, in the second embodiment of the closure 220 described above with reference to FIGS. 23-39. Analogously, the utensil 240 described above with reference to the second embodiment of the closure 220 illustrated in FIGS. 23-39 may be employed, with suitable modifications, in the first embodiment of the closure 20 described above with reference to FIGS. 1-22.

It will be readily apparent from the foregoing detailed description of the invention and from the illustrations thereof that numerous variations and modifications may be effected without departing from the true spirit and scope of the novel concepts or principles of this invention.

What is claimed is:

1. A closure for a container that has an interior where a product may be stored, said closure comprising:

(A) a body for extending from said container and defining an opening for communicating with the container interior;

(B) a lid;

(C) a hinge for connecting said lid with said body to accommodate movement of said lid between a closed position occluding said opening and an open position exposing said opening; and (D) a utensil initially molded with the same material as said body, and connected to said body wherein (1) said utensil initially extends across at least part of said body opening when said lid is initially in said open position exposing said body opening; and (2), said utensil is initially frangibly connected with a frangible connection at least at a first location to said body wherein said frangible connection accommodates a structural rupture of said frangible connection in response to application of a sufficient force;

said lid including a receiving structure adapted for holding said utensil in a releasable engagement of said utensil after said frangible connection has been broken and said utensil has been moved into releasable engagement with said receiving structure, whereby said utensil can be releasably held in said lid when said lid is in said open position and when said lid is in said closed position.

2. The closure in accordance with claim 1 in which said closure is adapted for attachment to a container that has a container opening to said container interior;

said closure is separate from, but releasably attachable to, said container around said container opening; and said closure body opening can communicate with said container opening when said closure body is attached to said container.

3. The closure in accordance with claim 2 for use with a container having an opening to the container interior, and in which said closure body has a skirt around said closure body opening and an upwardly facing, exterior, peripheral shoulder;

said skirt is adapted to engage said container around said container opening;

said closure body has a neck projecting upwardly from said closure body exterior peripheral shoulder;

said closure body neck has a laterally extending latch bead;

said lid has a peripheral flange with an end surface for being received on, and abutting, said closure body peripheral shoulder when said lid is in said closed position; and said peripheral flange of said lid has a laterally extending latch bead for engaging said latch bead on said closure body neck.

4. The closure in accordance with claim 1 in which said utensil is also frangibly connected to said body at a second location.

5. The closure in accordance with claim 4 in which said closure is molded from a polymeric material;

said utensil is frangibly connected at said first location to said closure body with a first frangible connection;

said utensil is frangibly connected at said second location to said closure body with a second frangible connection; and each said first frangible connection and said second frangible connection comprises a reduced cross-sectional thickness of said polymeric material between said closure body and said utensil.

6. The closure in accordance with claim 5 in which each said first frangible connection and said second frangible connection comprises a plurality of spaced-apart bridges extending between said utensil and said closure body.

7. The closure in accordance with claim 1 in which said utensil comprises a handle portion and a utility portion;

said utility portion has a first surface that is oriented towards said lid when said utensil is engaged with said receiving structure and held in said lid, and a second surface that is oriented away from said lid when said utensil is engaged with said receiving structure and held in said lid;

said handle portion extends from said utility portion from a location on said utility portion proximate said second surface; and whereby space is maintained between said lid and at least a portion of said handle portion when said utensil is engaged with said receiving structure and held in said lid.

8. The closure in accordance with claim 7 in which said utensil comprises a scoop having said handle portion and having a utility portion in the form of a scoop portion that defines said utility portion of said utensil.

9. The closure in accordance with claim 8 in which said scoop portion is defined by a top opening, peripheral side walls, and a bottom surface.

10. The closure in accordance with claim 1 in which said utensil is a spear.

11. The closure in accordance with claim 1 in which said utensil is configured to be initially connected to said body so as to locate said utensil upwardly relative to said frangible connection in the direction away from said closure body opening.

12. The closure in accordance with claim 1 in which said utensil defines an aperture; and said receiving structure in said lid includes a mounting post for being received in said utensil aperture to accommodate mounting of said utensil in said lid.

13. The closure in accordance with claim 1 in which said receiving structure in said lid include's indicia designating a placement location for storing said utensil in said lid.

14. The closure in accordance with claim 1 in which said receiving structure in said lid includes snap-fit type members projecting from said lid to engage portions of said utensil.

15. A closure for a container that has an interior where a product may be stored, said closure comprising:

(A) a body for extending from said container and defining an opening for communicating with the container interior;

(B) a utensil initially molded with said body wherein (1) said utensil extends across at least part of said body opening; and (2) said utensil is frangibly connected with a frangible connection at least at a first location to said body;

(3) said utensil includes a pointed barbed end and a handle portion that includes a central depression to accommodate grasping by a user's finger or thumb (C) a lid; and (D) a hinge for connecting said lid with said body to accommodate movement of said lid between a closed position occluding said opening and an open position exposing said opening; and said lid including a receiving structure adapted for holding said utensil in a releasable engagement of said utensil after said frangible connection has been broken and said utensil has been moved into engagement with said receiving structure, whereby said utensil can be held in said lid when said lid is in said open position and when said lid is in said closed position.

16. A closure for a container that has an interior where a product may be stored, said closure comprising:

(A) a body for extending from said container and defining an opening for communicating with the container interior;

(B) a utensil initially molded with said body wherein (1) said utensil extends across at least part of said body opening; and (2) said utensil is frangibly connected with a frangible connection at least at a first location to said body;

(3) said utensil includes, at a location adjacent said frangible connection, a sloping extension, a lateral extension extending from said sloping extension, and a sloping portion extending from said lateral extension to said frangible connection;

(C) a lid; and (D) a hinge for connecting said lid with said body to accommodate movement of said lid between a closed position occluding said opening and an open position exposing said opening; and said lid including a receiving structure adapted for holding said utensil in a releasable engagement of said utensil after said frangible connection has been broken and said utensil has been moved into engagement with said receiving structure, whereby said utensil can be held in said lid when said lid is in said open position and when said lid is in said closed position.

17. A closure for a container that has an interior where a product may be stored, said closure comprising:

(A) a body for extending from said container and defining an opening for communicating with the container interior;

(B) a utensil initially molded with said body wherein (1) said utensil extends across at least part of said body opening; and (2) said utensil is frangibly connected with a frangible connection at least at a first location to said body;

(3) at least some of said frangible connections are located in a lateral recess defined in said closure body adjacent said closure body opening;

(C) a lid; and (D) a hinge for connecting said lid with said body to accommodate movement of said lid between a closed position occluding said opening and an open position exposing said opening; and said lid including a receiving structure adapted for holding said utensil in a releasable engagement of said utensil after said frangible connection has been broken and said utensil has been moved into engagement with said receiving structure, whereby said utensil can be held in said lid when said lid is in said open position and when said lid is in said closed position.

18. A closure for a container that has an interior where a product may be stored, said closure comprising:

(A) a body for extending from said container and defining an opening for communicating with the container interior;

(B) a utensil initially molded with said body wherein (1) said utensil extends across at least part of said body opening; and (2) said utensil is frangibly connected with a frangible connection at least at a first location to said body;

said closure body initially includes a removable, internal, arcuate, ring-like member which is initially frangibly connected to the remaining portion of said closure body; and said frangible connection between said utensil and said closure body is defined by a frangible connection between said utensil and said internal, arcuate, ring-like member, whereby said internal, arcuate, ring-like member can be detached from the remaining portion of said closure body and whereby said utensil can be detached from said internal, arcuate, ring-like member;

(C) a lid; and (D) a hinge for connecting said lid with said body to accommodate movement of said lid between a closed position occluding said opening and an open position exposing said opening; and said lid including a receiving structure adapted for holding said utensil in a releasable engagement of said utensil after said frangible connection has been broken and said utensil has been moved into engagement with said receiving structure, whereby said utensil can be held in said lid when said lid is in said open position and when said lid is in said closed position.

19. The closure in accordance with claim 18 in which at least some of said frangible connections, when viewed in plan from above, have a partially triangular shape.

* * * * *